US009359907B2

(12) United States Patent
Tashima et al.

(10) Patent No.: US 9,359,907 B2
(45) Date of Patent: Jun. 7, 2016

(54) STATIONARY BLADE CASCADE, ASSEMBLING METHOD OF STATIONARY BLADE CASCADE, AND STEAM TURBINE

(71) Applicants: Tsuguhisa Tashima, Yokohama (JP); Itaru Murakami, Tokyo (JP); Motoki Yoshikawa, Kawasaki (JP)

(72) Inventors: Tsuguhisa Tashima, Yokohama (JP); Itaru Murakami, Tokyo (JP); Motoki Yoshikawa, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 645 days.

(21) Appl. No.: 13/687,030

(22) Filed: Nov. 28, 2012

(65) Prior Publication Data

US 2013/0149136 A1 Jun. 13, 2013

(30) Foreign Application Priority Data

Dec. 12, 2011 (JP) ..... 2011-271545

(51) Int. Cl.
*F01D 9/04* (2006.01)
*F01D 25/24* (2006.01)
(Continued)

(52) U.S. Cl.
CPC *F01D 9/04* (2013.01); *F01D 9/041* (2013.01); *F01D 11/001* (2013.01); *F01D 11/08* (2013.01);
(Continued)

(58) Field of Classification Search
CPC ..... F01D 9/02; F01D 9/04; F01D 9/041; F01D 9/042; F01D 9/047; F01D 25/246; F01D 11/08; F05D 2230/60; F05D 2230/64
USPC ..... 415/209.2–209.4, 189–190, 210.1, 415/213.1, 214
See application file for complete search history.

(56) References Cited

U.S. PATENT DOCUMENTS 930,908 A * 8/1909 Westinghouse ..... F01D 11/005 415/135
2,247,423 A * 7/1941 Webster, Jr. ..... 415/209.2
(Continued)

FOREIGN PATENT DOCUMENTS

DE 563 972 11/1932
EP 1 408 198 A1 4/2004
(Continued)

OTHER PUBLICATIONS

Extended European Search Report issued by the European Patent Office on Mar. 4, 2013, for European Patent Application No. 12196273.2.
(Continued)

*Primary Examiner* — Richard Edgar
*Assistant Examiner* — Eldon Brockman
(74) *Attorney, Agent, or Firm* — Finnegan, Henderson, Farabow, Garrett & Dunner, LLP

(57) ABSTRACT

A stationary blade cascade 29 of an embodiment includes stationary blade structures 50 and a ring-shaped support structure 40 supporting the stationary blade structures 50. The stationary blade structures 50 each include: a stationary blade part 51 where steam passes; and an outer circumference side constituent part 52 formed on an outer circumference side of the stationary blade part 51 and having a fitting groove 56 which penetrates all along a circumferential direction and which has an opening 55 all along the circumferential direction in a downstream end surface 54 of the outer circumference side constituent part 52. The support structure 40 includes a ring-shaped support part 42 having a fitting portion 41 fitted in the fitting grooves 56 of the outer circumference side constituent parts 52. The plural stationary blade structures 50 are supported along the circumferential direction by the ring-shaped support part 42.

14 Claims, 24 Drawing Sheets

(51) Int. Cl.
*F01D 11/00* (2006.01)
*F01D 11/08* (2006.01)

(52) U.S. Cl.
CPC ..... *F01D 25/246* (2013.01); *F05D 2220/31* (2013.01); *F05D 2230/60* (2013.01); *Y10T 29/49245* (2015.01)

(56) References Cited

U.S. PATENT DOCUMENTS

| | | | | |
|---|---|---|---|---|
| 4,687,413 | A * | 8/1987 | Prario | F01D 11/08 403/319 |
| 5,492,445 | A * | 2/1996 | Shaffer | F01D 25/246 415/246 |
| 5,743,711 | A | 4/1998 | Fournier et al. | |
| 6,062,813 | A * | 5/2000 | Halliwell et al. | 415/174.5 |
| 7,811,054 | B2 * | 10/2010 | Eastman et al. | 415/173.1 |
| 8,105,023 | B2 * | 1/2012 | Ikeda et al. | 415/170.1 |
| 8,562,292 | B2 * | 10/2013 | Burdgick | F01D 9/042 415/189 |
| 2003/0165382 | A1 * | 9/2003 | Suzuki | F01D 5/225 415/151 |
| 2004/0253095 | A1 | 12/2004 | Sasaki et al. | |
| 2005/0042077 | A1 * | 2/2005 | Gekht | F01D 9/04 415/116 |
| 2005/0111973 | A1 | 5/2005 | Sullivan et al. | |
| 2005/0254939 | A1 * | 11/2005 | Wunderlich | F01D 11/18 415/170.1 |
| 2007/0189893 | A1 * | 8/2007 | Burdgick | 415/213.1 |
| 2007/0258826 | A1 * | 11/2007 | Bracken et al. | 416/234 |
| 2008/0175706 | A1 * | 7/2008 | Ikeda et al. | 415/173.4 |
| 2008/0298956 | A1 * | 12/2008 | Eastman et al. | 415/173.1 |
| 2010/0083499 | A1 * | 4/2010 | Shigemoto et al. | 29/889.1 |
| 2010/0232934 | A1 * | 9/2010 | Burdgick | F01D 9/044 415/151 |
| 2011/0211946 | A1 * | 9/2011 | Burdgick | F01D 9/02 415/209.3 |
| 2011/0255959 | A1 * | 10/2011 | Klingler | 415/182.1 |
| 2012/0087788 | A1 * | 4/2012 | Anderson | F01D 9/065 415/210.1 |
| 2012/0141260 | A1 * | 6/2012 | Burdgick | F01D 9/042 415/191 |

FOREIGN PATENT DOCUMENTS

| | | |
|---|---|---|
| EP | 1 746 251 A1 | 1/2007 |
| FR | 633070 | 1/1928 |
| JP | 2003-97218 | 4/2003 |
| JP | 2005-146896 | 6/2005 |
| JP | 2005-155633 | 6/2005 |
| WO | WO 2008/081485 A1 | 7/2008 |

OTHER PUBLICATIONS

Notice of Comment Submission issued by the Korean Intellectual Property Office on Dec. 24, 2013, for Korean Patent Application No. 10-2012-0142533, and English-language translation thereof.

* cited by examiner

STATIONARY BLADE CASCADE, ASSEMBLING METHOD OF STATIONARY BLADE CASCADE, AND STEAM TURBINE

CROSS REFERENCE TO RELATED APPLICATION

This application is based upon and claims the benefit of priority from the prior Japanese Patent Application No. 2011-271545, filed on Dec. 12, 2011; the entire contents of which are incorporated herein by reference.

FIELD

Embodiments described herein relate generally to a stationary blade cascade, an assembling method of a stationary blade cascade, and a steam turbine.

BACKGROUND

Among steam turbines, there is widely used a steam turbine of an axial flow type in which a plurality of turbine stages each composed of a stationary blade cascade and a rotor blade cascade are arranged in a turbine rotor axial direction in which steam flows. A compact structure is required of such a steam turbine in view of improving space efficiency.

The rotor blade cascades in the steam turbine each include a plurality of rotor blades which are implanted in a circumferential direction of a turbine rotor. On the other hand, as for the stationary blade cascades, some has a plurality of stationary blades which are arranged in the circumferential direction between a diaphragm outer ring and a diaphragm inner ring, and some other has a plurality of stationary blades which are arranged in a circumferential direction on an inner circumference of a casing.

FIG. 22 is a view showing a meridian cross section of a conventional steam turbine including stationary blade cascades 310 between a diaphragm outer ring 312 and a diaphragm inner ring 314. In FIG. 22, a single turbine stage composed of the stationary blade cascade 310 and a rotor blade cascade 320 is shown.

The stationary blade cascade 310 is formed between the diaphragm outer ring 312 which has a groove 311 opening toward an inside diameter side and continuing in a circumferential direction of the diaphragm outer ring 312 and the diaphragm inner ring 314 which has a groove 313 opening toward an outside diameter side and continuing in a circumferential direction of the diaphragm inner ring 314. Stationary blades 315 each include, on its outer circumference side, an implantation portion 316 for diaphragm outer ring, and the implantation portions 316 for diaphragm outer ring are fitted in the groove 311.

The stationary blades 315 each include, on its inner circumference side, an implantation portion 317 for diaphragm inner ring, and the implantation portions 317 for diaphragm inner ring are fitted in the groove 313. That is, the stationary blades 315 are supported on the diaphragm outer ring 312 and the diaphragm inner ring 314 not by welding but by fitting. Further, on an outer circumference of the diaphragm outer ring 312, a casing 330 is provided to prevent high-temperature, high-pressure steam from leaking outside.

FIG. 23 is a view showing a meridian cross section of a conventional steam turbine including stationary blade cascades 355 each having stationary blades arranged in a circumferential direction on an inner circumference of a casing 350. As shown in FIG. 23, fitting grooves 351 are formed all along the circumferential direction in the inner circumference of the casing 350. Fitting portions 353 of stationary blades 352 are fitted in the fitting grooves 351 to be fixed to the casing 350, whereby the stationary blade cascades 355 are formed. Further, pressure pins 354 press the stationary blades 352 radially inward in order to firmly fix the stationary blades 352 to the casing 350.

In the conventional steam turbine including the stationary blade cascades 310 between the diaphragm outer ring 312 and the diaphragm inner ring 314, a clearance δr for allowing thermal expansion is provided between the casing 330 and the diaphragm outer ring 312 as shown in FIG. 22. That is, an inside diameter of the casing 330 is decided by an outside diameter of the stationary blades 315, a radial thickness of the diaphragm outer ring 312, the clearance δr, and so on.

Here, the outside diameter of the stationary blades 315 is a dimension set for optimizing performance depending on a stem flow rate and a steam condition, and the clearance δr is set in order to allow the thermal expansion, and their great changes are not allowed.

Further, for example, between the groove 311 and the implantation portions 316 for diaphragm outer ring, a slight gap is formed all along the circumferential direction. Therefore, on horizontal end surfaces (horizontal joint surfaces) of the diaphragm outer ring 312 having a two-divided structure of an upper half and a lower half, fastening bolts for fastening the upper half and the lower half and pins, keys, and the like for positioning need to be provided in order to prevent the leakage of steam. However, reducing the radial thickness of the diaphragm outer ring 312 necessitates the downsizing of the fastening bolts, pins, keys, and so on. This results in insufficient fastening force and positioning to cause a problem that the steam easily leaks at the horizontal end surfaces.

As described above, in the conventional steam turbine including the stationary blade cascades between the diaphragm outer ring and the diaphragm inner ring, it has been difficult to realize the downsizing.

In the conventional steam turbine including the stationary blade cascades 355 each having the stationary blades arranged in the circumferential directionon the inner circumference of the casing 350, the stationary blade cascades 355 expand radially inward and a turbine rotor 356 and the casing 350 expand radially outward at the time of the thermal expansion, as shown by the arrows in FIG. 23. At this time, the expansion of the casing 350 is small but the expansion of the stationary blade cascades 355 and the turbine rotor 356 is large. Accordingly, a gap between the stationary blade cascades 355 and the turbine rotor 356 becomes small, which has a risk that they come into contact with each other to cause a significant accident.

DETAILED DESCRIPTION

In one embodiment, a stationary blade cascade is a stationary blade cascade for steam turbine which includes a plurality of stationary blades arranged in a circumferential direction and which is formed in a ring shape. The stationary blade cascade includes stationary blade structures each having: a stationary blade part through which steam passes; and an outer circumference side constituent part which is formed on an outer circumference side of the stationary blade part and having a fitting groove which penetrates all along the circumferential direction and which has an opening all along the circumferential direction in an upstream end surface or a downstream end surface of the outer circumference side constituent part. The stationary blade cascade further includes a support structure in a ring shape having a ring-shaped support part which has a fitting portion fitted in the fitting grooves of the outer circumference side constituent parts and which supports the plural stationary blade structures along the circumferential direction.

Hereinafter, embodiments of the present invention will be described with reference to the drawings.

First Embodiment

Figure 1:
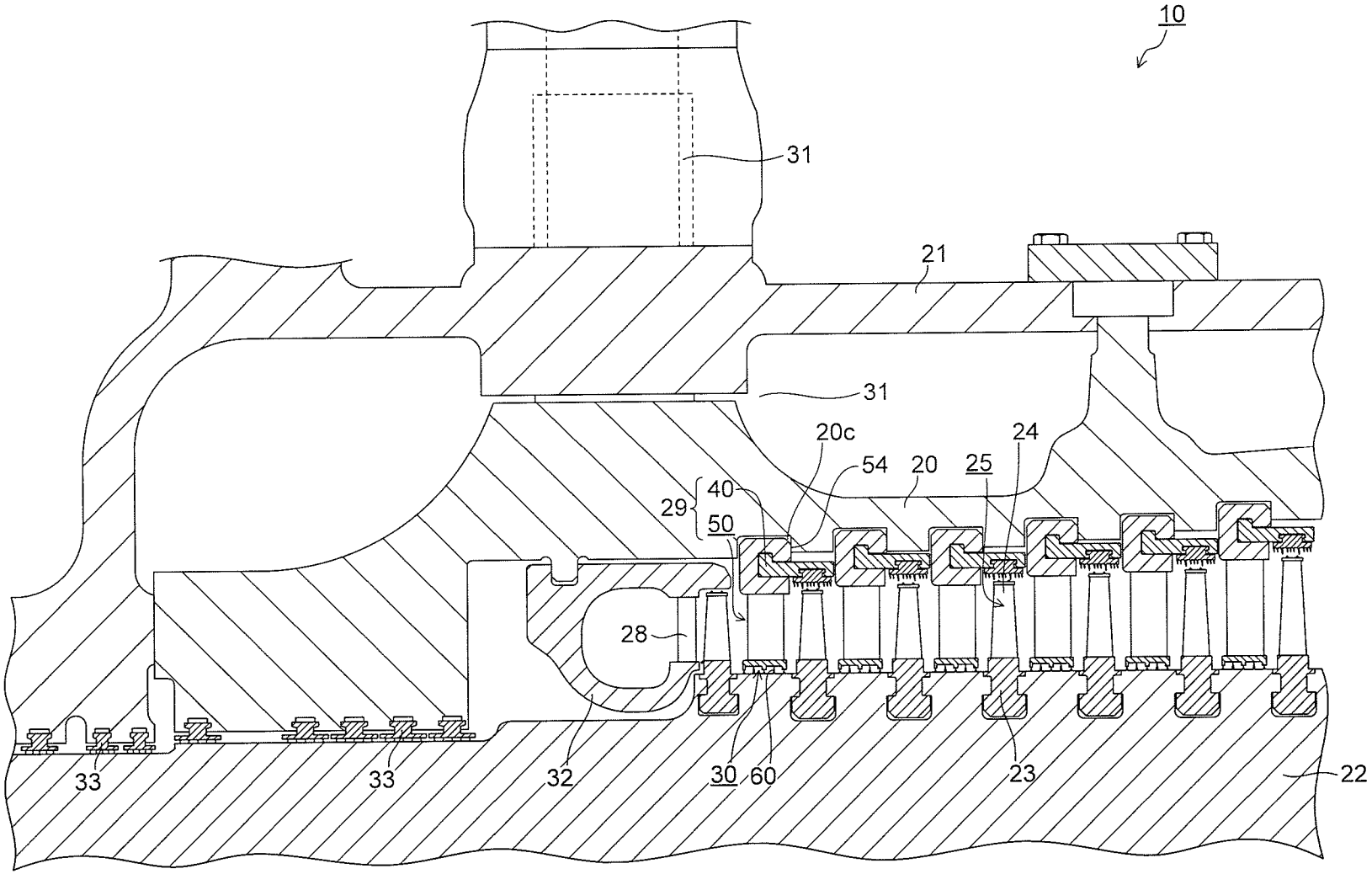
FIG. 1 is a view showing a meridian cross section of a steam turbine including a stationary blade cascade of a first embodiment.

FIG. 1 is a view showing a meridian cross section of a steam turbine 10 including a stationary blade cascade 29 of a first embodiment. Note that in the following, the same constituent parts are denoted by the same reference signs, and a duplicate description will be omitted or simplified.

Further, in the following description, as the steam turbine 10, a high-pressure turbine will be taken as an example, but the structure of this embodiment is applicable also to a low-pressure turbine, an intermediate-pressure turbine, and further a very high-pressure turbine. Further, the description here will be based on an example including a double-structured casing as a casing, but the casing may be a single-structured casing.

As shown in FIG. 1, the steam turbine 10 includes the double-structured casing composed of an inner casing 20 and an outer casing 21 provided on an outer side of the inner casing 20. In the inner casing 20, a turbine rotor 22 is penetratingly installed. On the turbine rotor 22, a plurality of stages of rotor disks 23 are arranged in a turbine rotor axial direction. On each of the rotor disks 23, a plurality of rotor blades 24 are implanted in a circumferential direction to form a rotor blade cascade 25.

On an inner circumference side of the inner casing 20, there is provided stationary blade cascades 29 in each of which a plurality of stationary blade structures 50 are supported by a support structure 40. A plurality of stages of the stationary blade cascades 29 are arranged in the turbine rotor axial direction alternately with the rotor blade cascades 25. The stationary blade cascade 29 and the rotor blade cascade 25 provided immediately downstream of the stationary blade cascade 29 form one turbine stage. The structure of the stationary blade cascade 29 will be described in detail later.

Here, the downstream side means a downstream side in terms of a direction in which main steam flows, and an upstream side means an upstream side in terms of the direction in which the main steam flows (the same applies to the below).

Between the stationary blade structures 50 and the turbine rotor 22, steam sealing structures 30 are provided to prevent the steam from leaking to the downstream side from between the stationary blade structures 50 and the turbine rotor 22.

Further, in the steam turbine 10, a steam inlet pipe 31 is provided to penetrate through the outer casing 21 and the inner casing 20, and an end portion of the steam inlet pipe 31 is connected to a nozzle box 32 to communicate therewith. Note that the initial-stage (first-stage) stationary blade cascade 29 includes stationary blades 28 which are attached to an outlet of the nozzle box 32 in a circumferential direction and has a different structure from a structure of the downstream-side stationary blade cascades 29.

A plurality of gland labyrinth seals 33 are provided along the turbine rotor axial direction on inner peripheries of the inner casing 20 and the outer casing 21 located more outward than a position where the nozzle box 32 is provided (outward in a direction along the turbine rotor 22, and more leftward than the nozzle box 32 in FIG. 1). These gland labyrinth seals 33 prevent the steam from leaking to the outside between the inner and outer casing 20, 21 and the turbine rotor 22.

In the steam turbine 10 having such a structure, the steam flowing into the nozzle box 32 via the steam inlet pipe 31 performs expansion work while passing in the turbine stages, to rotate the turbine rotor 22. Then, the steam having performed the expansion work passes through an exhaust passage (not shown) to be discharged to the outside of the steam turbine 10.

Here, the structure of the stationary blade cascade 29 of the first embodiment will be described in detail.

Figure 2:
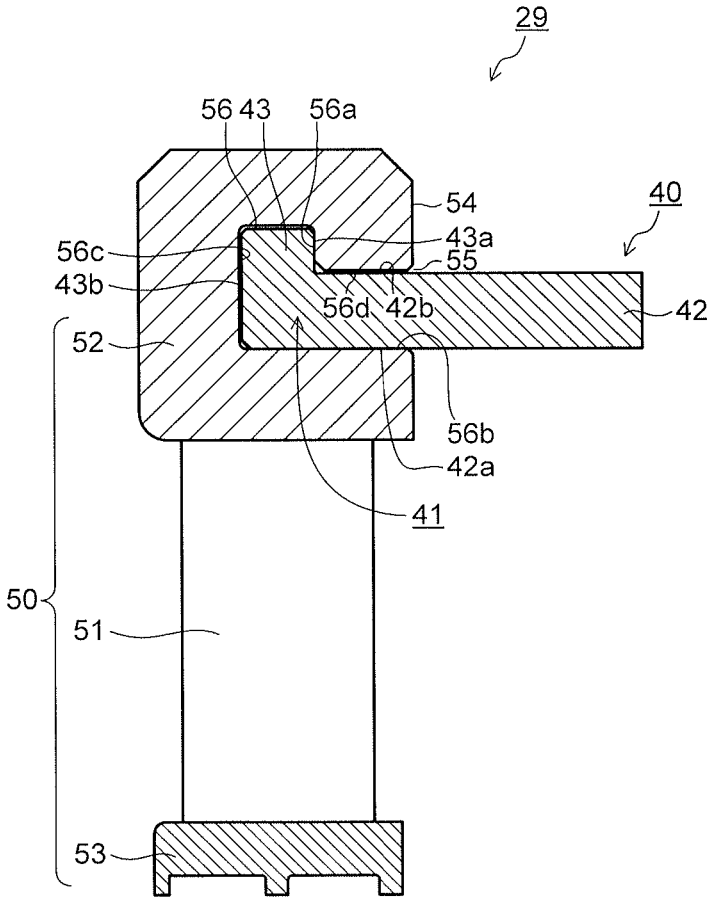
FIG. 2 is a view showing a meridian cross section of the stationary blade cascade of the first embodiment.
Figure 3:
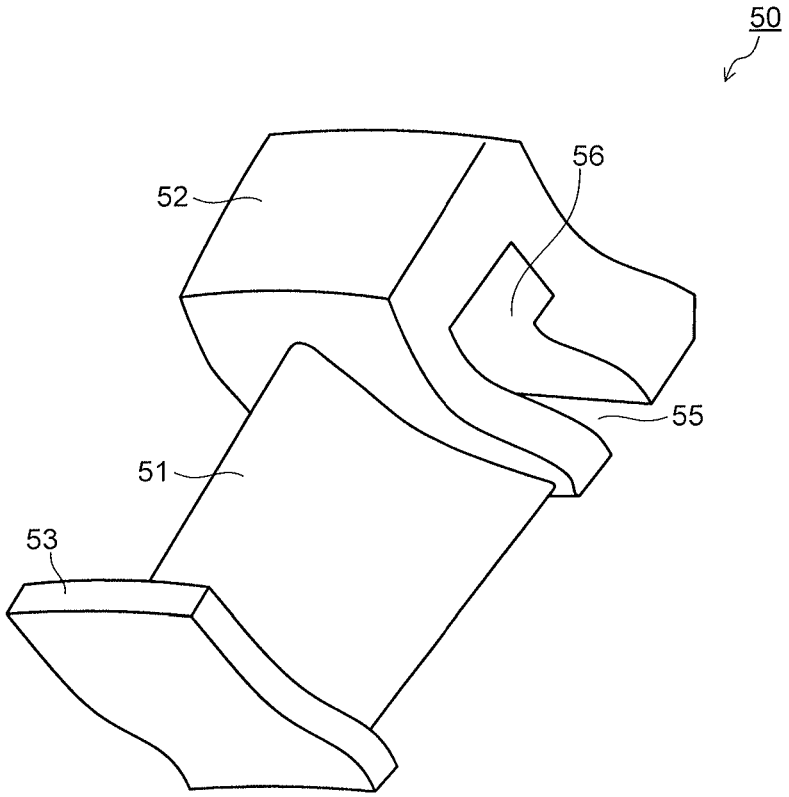
FIG. 3 is a perspective view showing a stationary blade structure included in the stationary blade cascade of the first embodiment.
Figure 4:
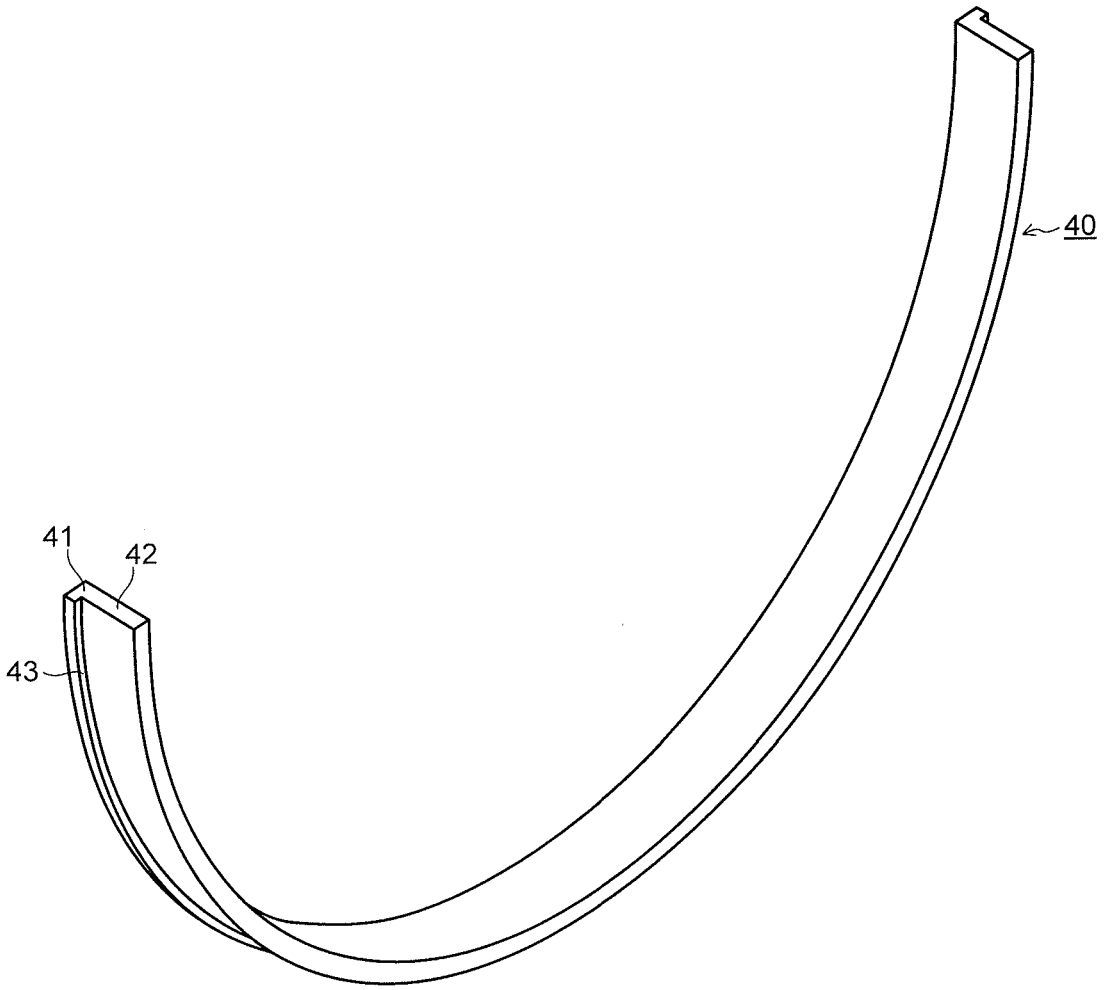
FIG. 4 is a perspective view showing a lower half of a support structure included in the stationary blade cascade of the first embodiment.
Figure 5:
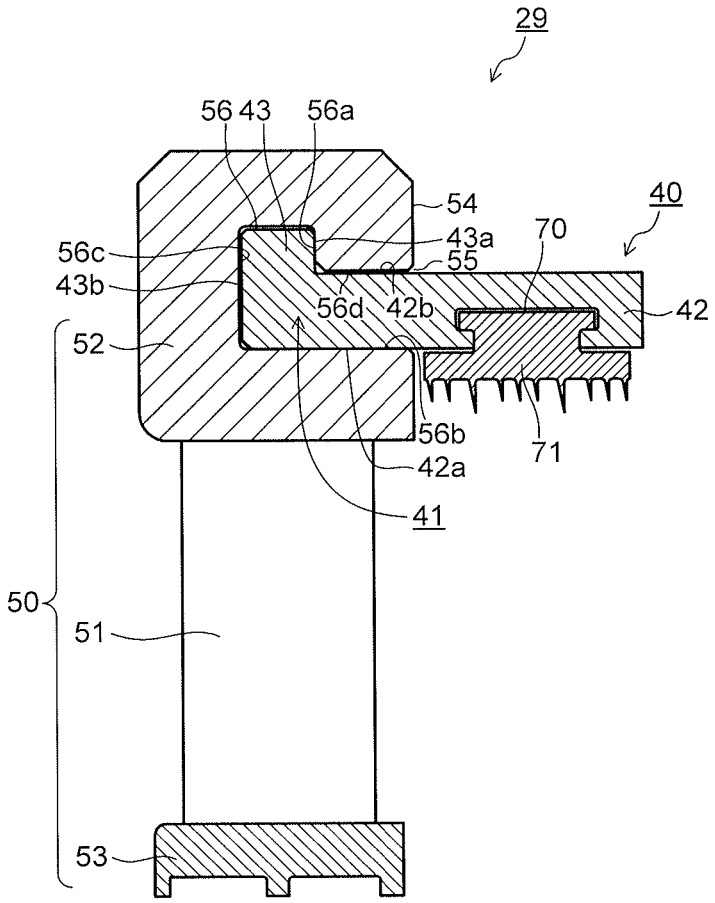
FIG. 5 is a view showing a meridian cross section of a stationary blade cascade including a steam sealing structure on the support structure, in the first embodiment.
Figure 6:
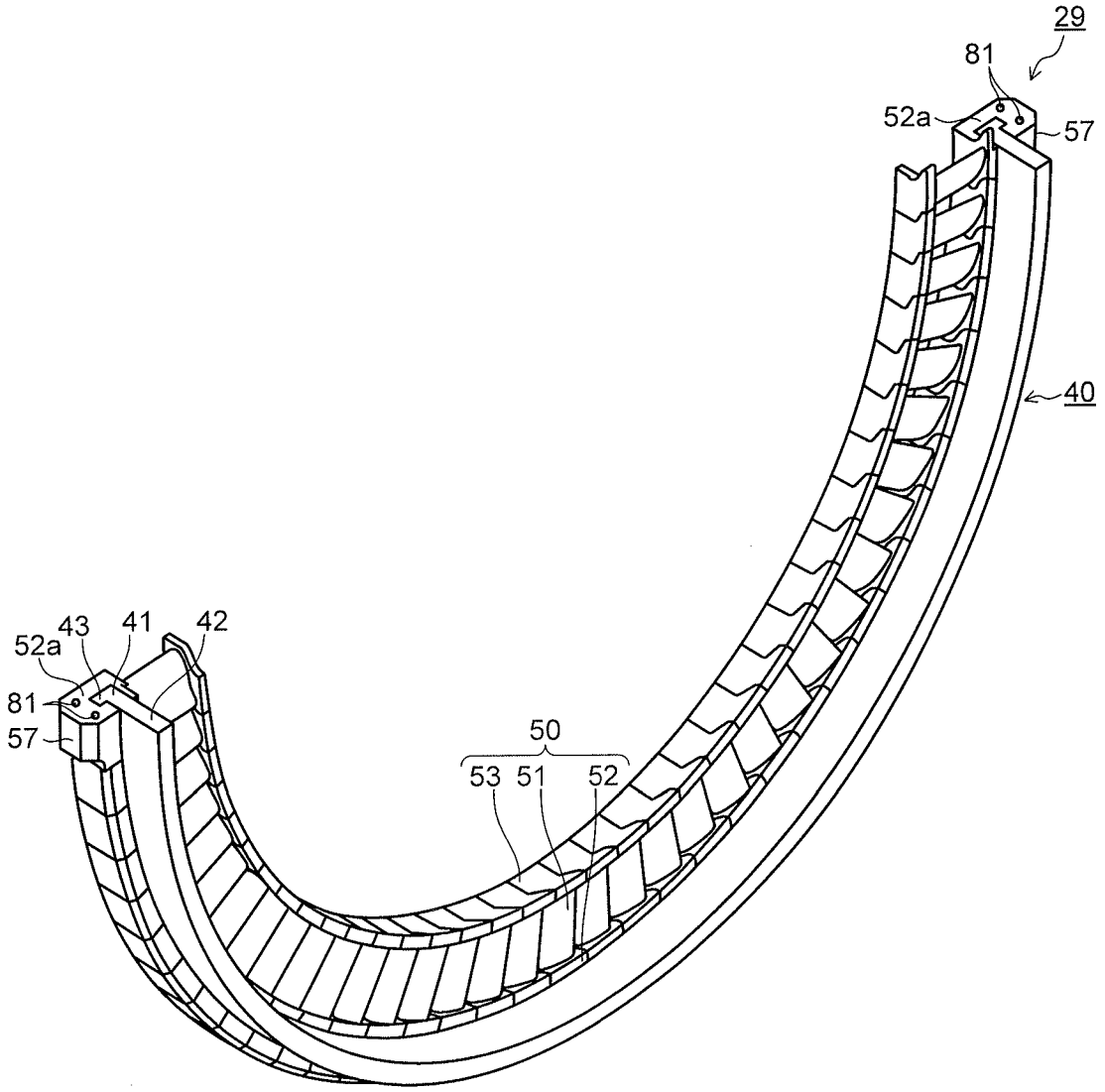
FIG. 6 is a perspective view showing a lower half of the stationary blade cascade of the first embodiment.
Figure 7:
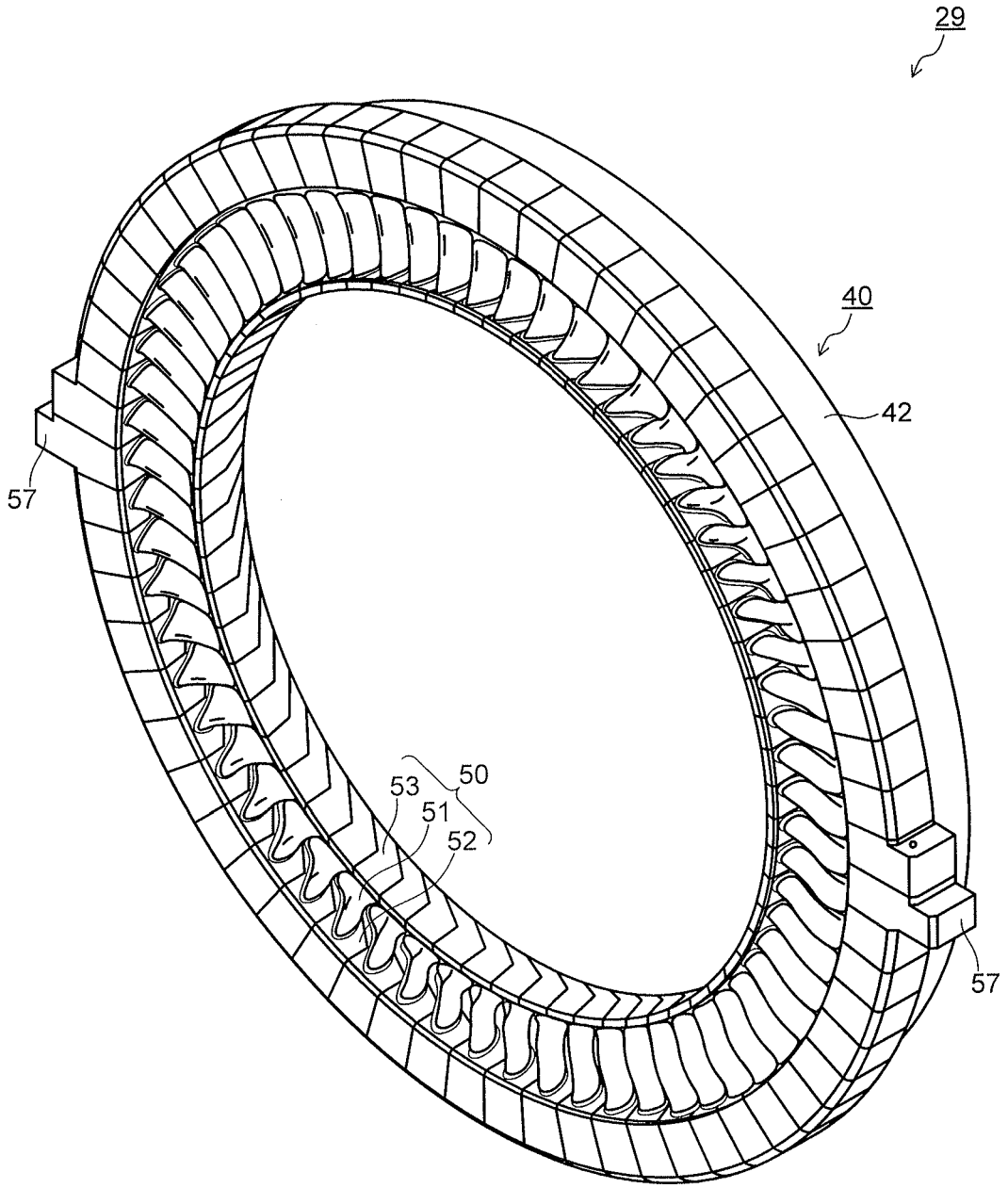
FIG. 7 is a perspective view showing the stationary blade cascade of the first embodiment.

FIG. 2 is a view showing a meridian cross section of the stationary blade cascade 29 of the first embodiment. FIG. 3 is a perspective view showing the stationary blade structure 50 included in the stationary blade cascade 29 of the first embodiment. FIG. 4 is a perspective view showing a lower half of the support structure 40 included in the stationary blade cascade 29 of the first embodiment. FIG. 5 is a view showing a meridian cross section of a stationary blade cascade 29 including a steam sealing structure on the support structure 40, in the first embodiment. FIG. 6 is a perspective view showing a lower half of the stationary blade cascade 29 of the first embodiment. FIG. 7 is a perspective view showing the stationary blade cascade 29 of the first embodiment.

As shown in FIG. 2, the stationary blade cascade 29 includes the stationary blade structures 50 and the ring-shaped support structure 40 supporting the stationary blade structures 50. The stationary blade structures 50 each include a stationary blade part 51, an outer circumference side constituent part 52, and an inner circumference side constituent part 53.

As shown in FIG. 2 and FIG. 3, the stationary blade part 51 forms a channel where the steam passes and has a wing shape with its upstream end portion being a leading edge and its downstream end portion being a trailing edge.

The outer circumference side constituent part 52 is formed on an outer circumference side of the stationary blade part 51 and is formed of a ring-shaped block structure. In the outer circumference side constituent part 52, a fitting groove 56 is formed which penetrates all along the circumferential direction and has an opening 55 all along the circumferential direction in a downstream end surface 54. As shown in FIG. 2, the fitting groove 56 is formed so that it has a predetermined groove width in a radial direction, and on an upstream side (left side in FIG. 2), the groove widens radially outward to increase the groove width. That is, in the cross section shown in FIG. 2, the fitting groove 56 is formed in an L-shape.

As shown in FIG. 1, in the outer circumference side constituent parts 52, radially outward portions of the outer circumference side constituent parts 52 are fitted in grooves 20*c* formed all along the circumferential direction in an inner wall of the inner casing 20 so as to be movable in the turbine rotor axial direction and radially outward. During the operation of the steam turbine, the downstream end surfaces 54 of the outer circumference side constituent parts 52 contact on a downstream end surface of the groove 20*c*, so that the movement of the stationary blade cascade 29 in the turbine rotor axial direction is prevented.

The inner circumference side constituent part 53 is formed on an inner circumference side of the stationary blade part 51 and is formed of a ring-shaped block structure. On an inner side of the inner circumference side constituent part 53, for example, a steam sealing structure is provided. An example of the steam sealing structure is a labyrinth packing or the like. For example, on the inner side of the inner circumference side constituent part 53, an unleveled structure is formed, which is provided so as to face a seal fin 60 (refer to FIG. 1) provided on a surface of the turbine rotor 22.

Here, the stationary blade structure 50 having the above-described structure is formed by, for example, precision casting or machining, and the stationary blade part 51, the outer circumference side constituent part 52, and the inner circumference side constituent part 53 are integrally formed. Owing to such a structure not using welding or the like, it is possible for a dimension error to be within a range of the accumulation of machining tolerances and further to reduce cost and so on required for the welding.

As shown in FIG. 2 and FIG. 4, the support structure 40 includes a ring-shaped support part 42 having a fitting portion 41 fitted in the fitting groove 56 of the outer circumference side constituent part 52. The support structure 40 has a two-divided structure of an upper half and a lower half, for example, as shown in FIG. 4. That is, the support structure 40 is composed of two semicircular rings into which it is divided along a horizontal joint position. The fitting portion 41 has the same shape as the shape of the fitting groove 56 of the outer circumference side constituent part 52, and includes a ridge portion 43 which is its one edge (upstream-side edge) projecting radially outward. That is, in the cross section shown in FIG. 2, the support structure 40 is formed in an L-shape.

Here, the example where the support structure 40 has the two-divided structure of the upper half and the lower half, but the structure of the support structure 40 is not limited to this, and may be a structure divided into a large number of parts. In this case, the upper half of the support structure 40 and the lower half of the support structure 40 are each formed by coupling the plural segmental support structures 40.

As shown in FIG. 2, the ring-shaped support part 42 extends in the turbine rotor axial direction and, for example, may extend in the turbine rotor axial direction so as to cover a periphery of the rotor blade cascade located downstream of the stationary blade cascade 29. In this case, as shown in FIG. 1 and FIG. 5, a steam sealing structure can be provided on an inner circumference side, of the ring-shaped support part 42, facing the rotor blade cascade 25. For example, as shown in FIG. 5, a labyrinth packing 71 can be put in a fitting groove 70 formed all along the circumferential direction in the inner circumference side, of the ring-shaped support part 42, facing the rotor blade cascade 25.

Here, as shown in FIG. 2, during the operation, a downstream end surface 43*a* of the ridge portion 43 of the support structure 40 contacts on an inner wall surface 56*a* of the fitting groove 56 and an inner circumference-side end surface 42*a* of the ring-shaped support part 42 contacts on an inner wall surface 56*b* of the fitting groove 56, in order to prevent the leakage of the steam. In this case, a gap between an upstream end surface 43*b* of the ridge portion 43 (fitting portion 41) and an inner wall surface 56*c* of the fitting groove 56 and a gap between a radially outward end surface 42*b* of the ring-shaped support part 42 and an inner wall surface 56*d* of the fitting groove 56 are preferably set within a range of 0.03 mm to 0.12 mm. Note that it has been also confirmed by FEM (finite element method) analysis, a mockup test, or the like that this dimension of these gaps is the most proper value. When the gaps are narrower than 0.03 mm, easy assembly is not possible. On the other hand, when the gaps are wider than 0.12 mm, rattling occurs during the operation.

By fitting the fitting grooves 56 of the above-described stationary blade structures 50 to the fitting portion 41 of the support structure 40 to mount the plural stationary blade structures 50 in the circumferential direction, it is possible to form the lower half of the stationary blade cascade 29 as shown in FIG. 6. Further, on the lower half of the stationary blade cascade 29, an upper half of the stationary blade cascade 29 assembled similarly to the lower half of the stationary blade cascade 29 is installed, whereby it is possible to form the ring-shaped stationary blade cascade 29 as shown in FIG. 7.

Here, a structure for supporting the lower half of the stationary blade cascade 29 on a lower half of the inner casing 20 will be described.

Figure 8:
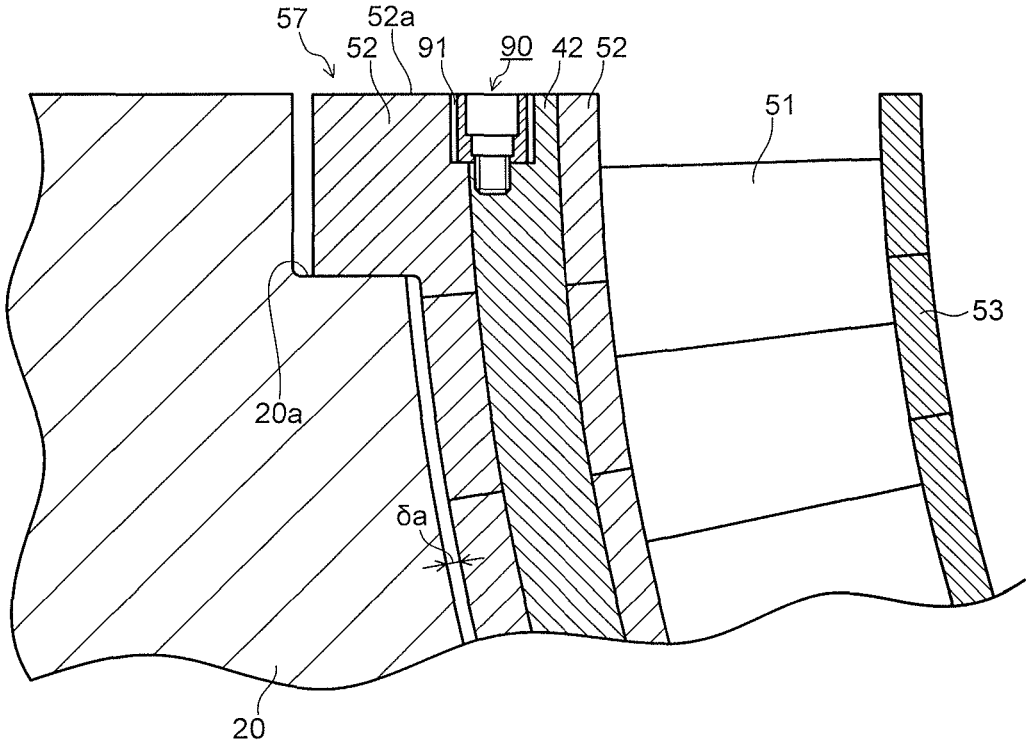
FIG. 8 is a view showing part of a cross section perpendicular to a turbine rotor axial direction, of a horizontal end portion side when the lower half of the stationary blade cascade of the first embodiment is installed on a lower half of an inner casing.
Figure 9A:
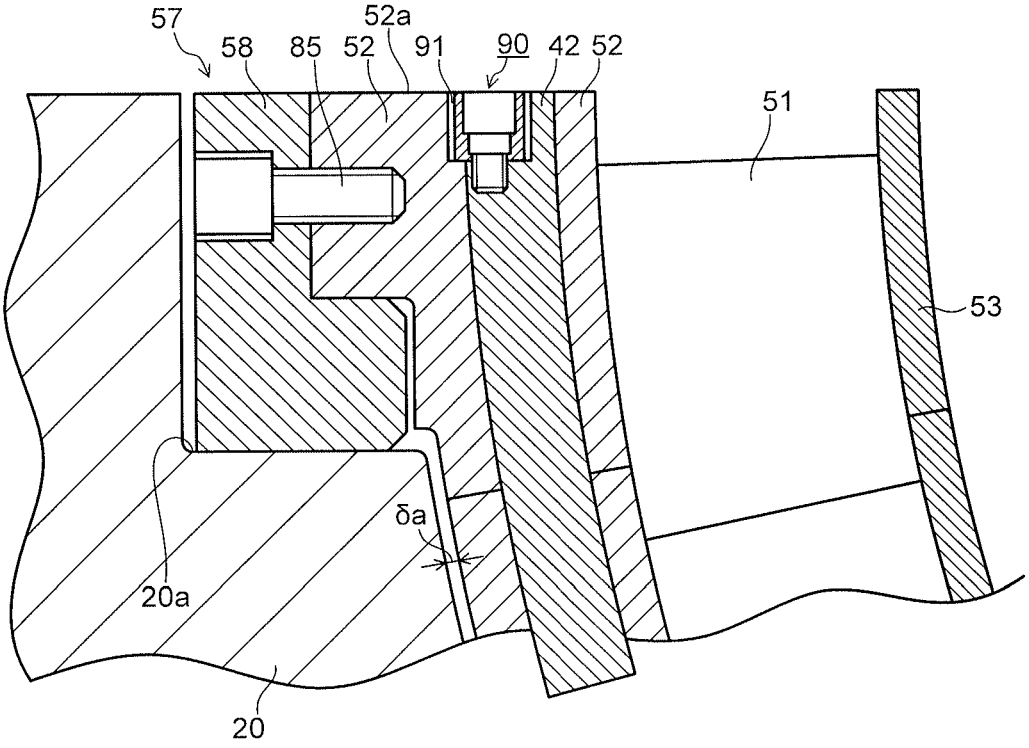
FIG. 9A is a view showing part of a cross section perpendicular to the turbine rotor axial direction, of the horizontal end portion side when the lower half of the stationary blade cascade of the first embodiment is installed on the lower half of the inner casing.
Figure 9B:
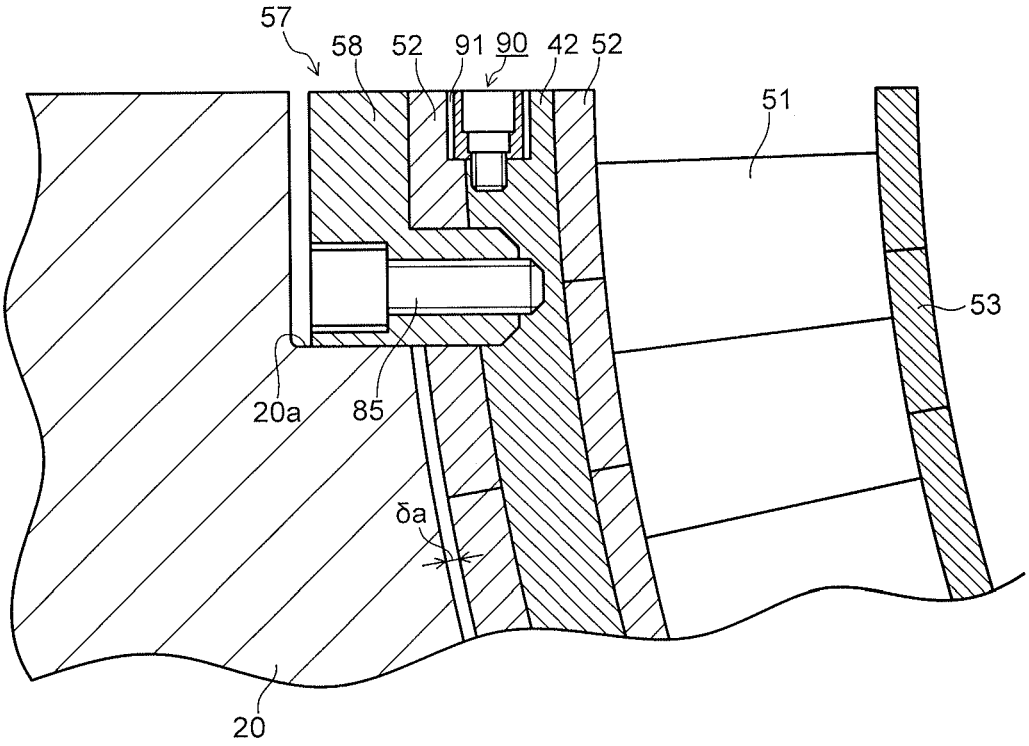
FIG. 9B is a view showing part of a cross section perpendicular to the turbine rotor axial direction, of the horizontal end portion side when the lower half of the stationary blade cascade of the first embodiment is installed on the lower half of the inner casing.
Figure 10A:
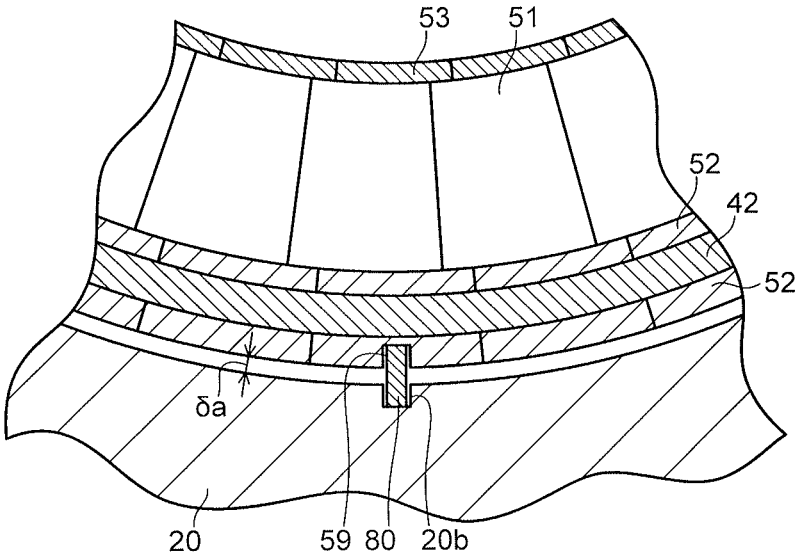
FIG. 10A is a view showing part of a cross section perpendicular to the turbine rotor axial direction, of a lowest portion when the lower half of the stationary blade cascade of the first embodiment is installed on the lower half of the inner casing.
Figure 10B:
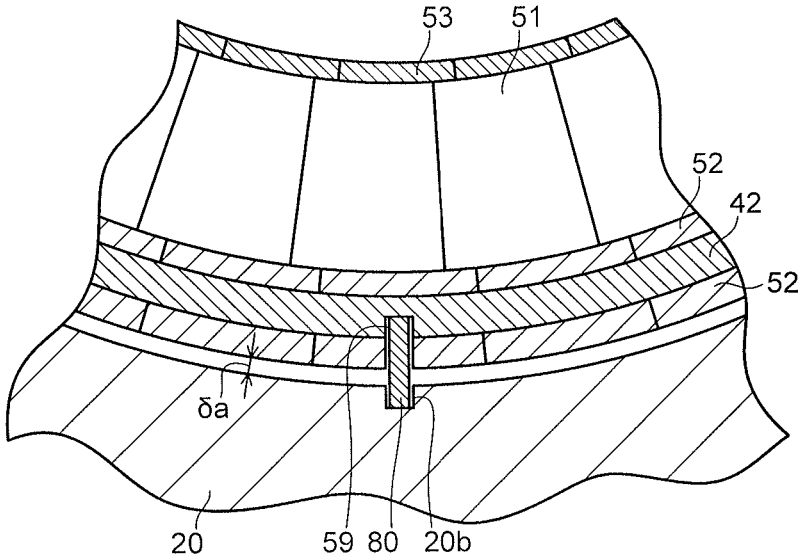
FIG. 10B is a view showing part of a cross section perpendicular to the turbine rotor axial direction, of the lowest portion when the lower half of the stationary blade cascade of the first embodiment is installed on the lower half of the inner casing.
Figure 11:
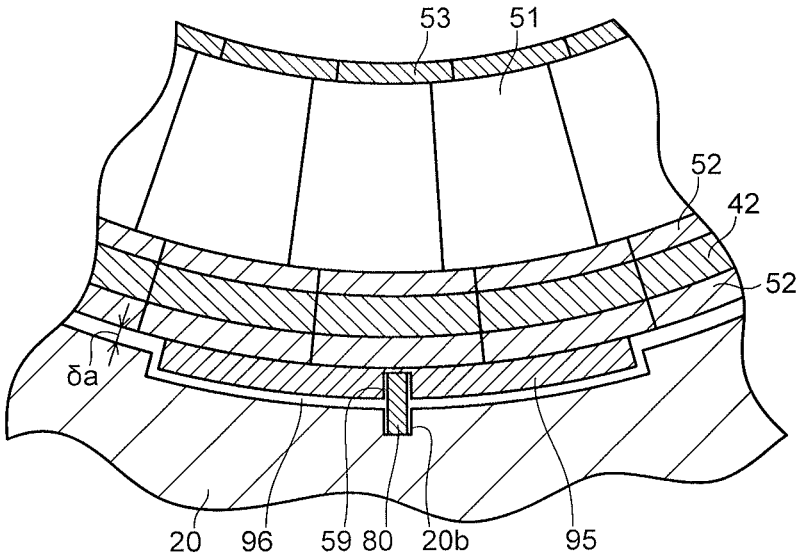
FIG. 11 is a view showing part of the cross section perpendicular to the turbine rotor axial direction, of the lowest portion when the lower half of the stationary blade cascade of the first embodiment is installed on the lower half of the inner casing.

FIG. 8, FIG. 9A, and FIG. 9B are views each showing part of a cross section perpendicular to the turbine rotor axial direction, of a horizontal end portion side when the lower half of the stationary blade cascade 29 of the first embodiment is installed on the lower half of the inner casing 20. FIG. 10A, FIG. 10B, and FIG. 11 are views each showing part of a cross section perpendicular to the turbine rotor axial direction, of a lowest portion when the lower half of the stationary blade cascade 29 of the first embodiment is installed on the lower half of the inner casing 20.

As shown in FIG. 8, FIG. 9A, and FIG. 9B, on each of the outer circumference side constituent parts 52 of the stationary blade structures 50 located on the horizontal end portion sides among the stationary blade structures 50 fitted to the fitting portion 41 of the lower half of the ring-shaped support part 42, or on the ring-shaped support part 42, there is provided an engagement portion 57 which is engaged with a stepped portion 20*a* formed on a horizontal end portion side of the lower half of the inner casing 20 and projects radially outward. When the engagement portions 57 are engaged with the stepped portions 20*a*, the lower half of the stationary blade cascade 29 is vertically positioned and the lower half of the stationary blade cascade 29 is supported by the lower half of the inner casing 20.

Here, the horizontal end portion is, in other words, a horizontal joint portion (horizontal joint surface) of each of the two segmental upper half and lower half. Further, the stationary blade structure 50 located on the horizontal end portion side means the stationary blade structure 50 located closest to the horizontal joint surface.

For example, as shown in FIG. 8, the outer circumference side constituent part 52 of the stationary blade structure 50 located on the horizontal end portion side is extended radially outward, whereby it is possible to form the engagement portion 57. Alternatively, for example, as shown in FIG. 9A, an engagement member 58 projecting radially outward is joined onto an outer periphery of the outer circumference side constituent part 52 of the stationary blade structure 50 located on the horizontal end portion side, whereby it is also possible to form the engagement portion 57. Alternatively, for example, as shown in FIG. 9B, the engagement member 58 projecting radially outward is joined onto the ring-shaped support part 42, whereby it is also possible to form the engagement portion 57. The engagement member 58 can be joined by, for example, bolt fastening, welding, or the like. FIG. 9A shows an example where a bolt 85 is fastened to the engagement member 58 and the outer circumference side constituent part 52 on an outer periphery side from the radially outer side, at the horizontal end portion side of the stationary blade cascade 29. Further, FIG. 9B shows an example where the bolt 85 is fastened to the engagement member 58 and the ring-shaped support part 42 from the radially outer side, at the horizontal end portion side of the stationary blade cascade 29.

Further, as shown in FIG. 10A, a concave portion 59 formed of, for example, a cylindrical concave groove is formed in an outer circumferential end surface of the outer circumference side constituent part 52 of the stationary blade structure 50 located lowest among the stationary blade structures 50 fitted to the fitting portion 41 of the lower half of the ring-shaped support part 42. Here, the concave portion 59 formed of the cylindrical concave groove may penetrate through the outer circumference side constituent part 52 on the outer periphery side and may be formed all along an outer circumferential end surface of the ring-shaped support 42 as shown in FIG. 10B. Further, in an inner circumferential surface, of the inner casing 20, facing the concave portion 59, a concave portion 20*b* having the same shape as that of the concave portion 59 is formed.

To support the lower half of the stationary blade cascade 29 by the lower half of the inner casing 20, a fitting member 80 fitted in the concave portion 59 and the concave portion 20*b* is attached. The fitting member 80 is formed of, for example, a columnar pin member or the like fitted in the concave portion 59 and the concave portion 20*b*. Thus attaching the fitting member 80 fitted in the concave portion 59 and the concave portion 20*b* results in the positioning in the circumferential direction and a direction perpendicular and horizontal to the turbine rotor axial direction (left and right direction in FIG. 10A and FIG. 10B).

As described above, the lower half of the stationary blade cascade 29 is supported by the lower half of the inner casing 20 mainly via the engagement portions 57, and between the outer circumference side constituent parts 52 of the stationary blade structures 50 except those on the horizontal end portion sides and the inner casing 20, there is a predetermined gap δa in the radial direction.

Here, the structure of the outer circumference side constituent part 52 of the stationary blade structure 50 located lowest is not limited to the above-described structures and may be a structure showing in FIG. 11. Specifically, a block member 95 in a flat plate shape having a predetermined thickness may be welded or bolt-fastened to the outer circumferential end surface of the outer circumference side constituent part 52 of the stationary blade structure 50 located lowest, and the aforesaid concave portion 59 formed of the cylindrical concave groove may be formed in the block member 95.

In this case, as shown in FIG. 11, in the inner circumferential surface, of the inner casing 20, facing the block member 95, a groove portion 96 indented radially outward is formed. The concave portion 20*b* is formed in the inner circumferential surface of the inner casing 20 in which the groove portion 96 is formed.

In such a structure, the concave portion 59 is not formed in the outer circumference side constituent part 52. Consequently, it is possible to prevent a local reduction of the radial thickness of the outer circumference side constituent part 52, which can prevent a decrease in strength.

In this case, the block member 95 having the concave portion 59 may be provided on an upstream end surface of the outer circumference side constituent part 52 of the stationary blade structure 50 located lowest. In this case, the block member 95 can be structured so as not to project radially outward from the outer circumferential end surface of the outer circumference side constituent part 52. Therefore, there is no need to form the groove portion 96 in the inner circumferential surface of the inner casing 20. This makes it possible to provide the positioning structure without increasing an outside diameter of the stationary blade structure 50 and an outside diameter of the inner casing 20.

Here, a reason why the block member 95 is not provided on the downstream end surface 54 of the outer circumference side constituent part 52 is not to hinder the later-described contact of the downstream end surface of the groove 20*c* formed in the inner wall of the inner casing 20 with the end surface 54.

Further, in order to prevent the stationary blade structures 50 on the horizontal end portion sides from detaching from the fitting portion 41 of the ring-shaped support part 42 when the lower half of the stationary blade cascade 29 is supported by the lower half of the inner casing 20, detachment preventing members 90 are provided on the horizontal end portion sides on the lower half side as shown in FIG. 8, FIG. 9A, and FIG. 9B.

The detachment preventing member 90 can be structured as follows, for instance. As shown in FIG. 8, FIG. 9A, and FIG. 9B, a concave portion 91 is formed all along the horizontal end portions of the ring-shaped support part 42 and the outer circumference side constituent part 52 located more radially outward than the ring-shaped support part 42. A block forming member which comes into contact with both a concave portion bottom surface of the outer circumference side constituent part 52 side and a concave portion bottom surface of the ring-shaped support part 42 and functioning as the detachment preventing member 90 is fixed to the ring-shaped support part 42 by, for example, a bolt or the like.

By the detachment preventing member 90 coming into contact with both the concave portion bottom surface of the outer circumference side constituent part 52 side and the concave portion bottom surface of the ring-shaped support part 42, it is possible to prevent the stationary blade structure 50 on the horizontal end portion side from detaching from the fitting portion 41 of the ring-shaped support part 42.

In order to prevent the stationary blade structures 50 on the horizontal end portion sides from detaching from the fitting portion 41 of the ring-shaped support part 42 in the upper half of the stationary blade cascade 29, the above-described detachment preventing members 90 are also provided on the horizontal end portion sides on the upper half side.

Further, as shown in FIG. 6, in each of horizontal end surfaces 52*a* of the outer circumference side constituent parts 52 of the stationary blade structures 50 located on the horizontal end portion sides on the lower half side, positioning holes 81 for positioning the upper half of the stationary blade cascade 29 when it is installed on the lower half of the stationary blade cascade 29 is formed. Further, on each of the horizontal end surfaces of the outer circumference side constituent parts 52 of the stationary blade structures 50 located on the horizontal end portion sides on the upper half side, positioning pins, not shown, fitted in the positioning holes 81 are provided, for instance. In order to reserve portions where to provide the positioning pins, the outer circumference side constituent parts 52 of the stationary blade structures 50 located on the horizontal end portion sides on the upper half side are structured to project radially outward as shown in FIG. 7.

Another possible structure is to form positioning holes also in the outer circumference side constituent parts 52 of the stationary blade structures 50 located on the horizontal end portion sides on the upper half side and to fit the positioning pins in the both positioning holes. Further, for the positioning and fixing, the outer circumference side constituent parts 52 on the horizontal end portion sides on the upper half side and the outer circumference side constituent parts 52 on the horizontal end portion sides on the lower half side may be fastened by, for example, bolts.

Next, an assembling method of the stationary blade cascade 29 will be described.

Figure 12:
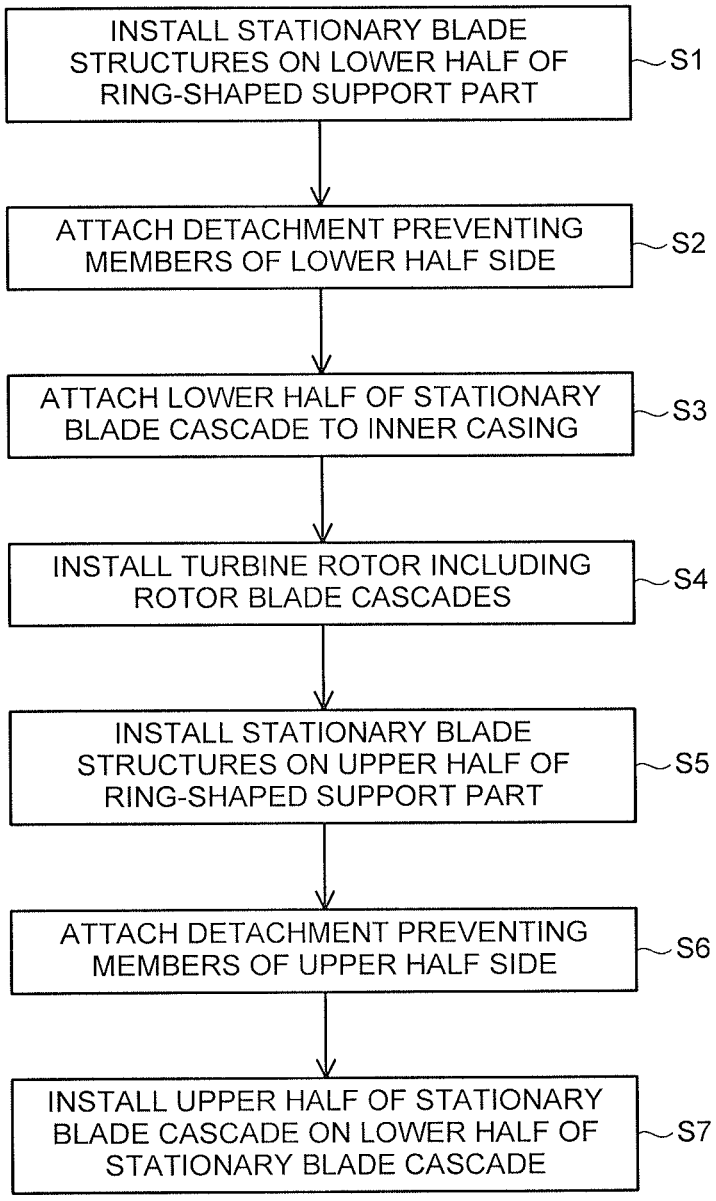
FIG. 12 is a chart showing the outline of assembly processes of an assembling method of the stationary blade cascade of the first embodiment.

FIG. 12 is a chart showing the outline of assembly processes of the assembling method of the stationary blade cascade 29 of the first embodiment. Here, processes for assembling the constituent components forming the above-described stationary blade cascade 29 will be described.

First, the fitting grooves 56 of the stationary blade structures 50 are fitted to the fitting portion 41 of the lower half of the ring-shaped support part 42, whereby the plural stationary blade structures 50 are installed in the circumferential direction (Step S1). For example, the stationary blade structures 50 are fitted from the horizontal end portion of the lower half of the ring-shaped support part 42, are moved in the circumferential direction while sliding, and are densely provided in the circumferential direction.

Subsequently, the detachment preventing members 90 which prevent the stationary blade structures 50 from detaching from the horizontal end portions of the lower half of the ring-shaped support part 42, are attached (Step S2). Here, the method of attaching the detachment preventing members 90 is as described previously. Consequently, the lower half of the stationary blade cascade 29 attachable to the lower half of the inner casing 20 is completed.

Subsequently, the lower half of the stationary blade cascade 29 is attached to the inner casing 20 (Step S3). Here, as previously described, the engagement portions 57 formed on the outer circumference side constituent parts 52 of the stationary blade structures 50 located on the horizontal end portion sides among the stationary blade structures 50 fitted to the lower half of the ring-shaped support part 42, are engaged with the stepped portions 20*a* formed on the horizontal end portion sides of the lower half of the inner casing 20. Further, when the stationary blade cascade 29 is engaged with the stepped portions 20*a*, the fitting member 80 is fitted between the concave portion 59, which is formed in the outer circumferential end surface of the outer circumference side constituent part 52 of the stationary blade structure 50 located lowest among the stationary blade structures 50 fitted to the lower half of the ring-shaped support part 42, and the concave portion 20*b*, which is formed in the inner circumference of the lower half of the inner casing 20.

In processes similar to the above-described processes, the lower halves of the plural stages of the stationary blade cascades 29 which are to be installed in the turbine rotor axial direction are installed.

Subsequently, the turbine rotor 22 in which the rotor blade cascades 25 are formed in correspondence to the stationary blade cascades 29 is installed so that the rotor blade cascades 25 are disposed alternately with the lower halves of the ring-shaped support parts 42, that is, the lower halves of the stationary blade cascades 29 in the turbine rotor axial direction (Step S4).

Subsequently, the fitting grooves 56 of the stationary blade structures 50 are fitted to the fitting portion 41 of the upper half of the ring-shaped support part 42, whereby the plural stationary blade structures 50 are installed in the circumferential direction (Step S5). The stationary blade structures 50 are, for example, fitted from the horizontal end portion of the upper half of the ring-shaped support part 42, are moved in the circumferential direction while sliding, and are densely provided in the circumferential direction.

Subsequently, the detachment preventing members 90 which prevent the stationary blade structures 50 from detaching from the horizontal end portions of the upper half of the ring-shaped support part 42, are attached (Step S6). Here, the method of attaching the detachment preventing members 90 is as previously described. Consequently, the upper half of the stationary blade cascade 29 attachable to the already installed lower half of the stationary blade cascade 29 is completed.

The process for assembling the upper half of the stationary blade cascade 29 is not necessarily performed here, but may be performed at the beginning of the assembling process of the stationary blade cascade 29. That is, the process for assembling the upper half of the stationary blade cascade 29 may be performed with the process for assembling the lower half of the stationary blade cascade 29.

Subsequently, the upper half of the ring-shaped support part 42 to which the detachment preventing members 90 are attached, that is, the upper half of the stationary blade cascade 29 is installed on the lower half of the stationary blade cascade 29, whereby the ring-shaped stationary blade cascade 29 is formed (Step S7). The ring-shaped stationary blade cascade 29 has a structure shown in FIG. 7, for instance. Note that in FIG. 7, the lower half of the inner casing 20 and the turbine rotor 22 including the rotor blade cascades 25 are not illustrated.

At this time, for the positioning, for example, the positioning pins (not shown) provided on the horizontal end surfaces of the outer circumference side constituent parts 52 of the stationary blade structures 50 located on the horizontal end portion sides on the upper half side, are fitted in the positioning holes 81 formed in the horizontal end surfaces of the outer circumference side constituent parts 52 of the stationary blade structures 50 located on the horizontal end portion sides on the lower half side.

In processes similar to the above-described processes for assembling the upper half of the stationary blade cascade 29, upper halves of the plural stages of the stationary blade cascades 29 which are to be installed in the turbine rotor axial direction in correspondence to the lower halves of the stationary blade cascades 29, are installed.

Through the above-described processes, the plural stages of ring-shaped stationary blade cascades 29 can be formed in the turbine rotor axial direction. Note that as for the stationary blade cascade 29 of this embodiment, only one stage thereof may be provided at least in the steam turbine. Therefore, except the initial-stage stationary blade cascade 29 provided on the nozzle box 32, all the stationary blade cascades 29 may have the structure of the stationary blade cascade 29 of this embodiment or only some of the stationary blade cascades 29 may have the structure of the stationary blade cascade 29 of this embodiment.

According to the stationary blade cascade 29 of the first embodiment described above, it is possible to support the stationary blade structures 50 by the support structure 40 provided on the inner side of the casing without providing a diaphragm outer ring. This makes it possible to make the outside diameters of the stationary blade cascade 29 and the inner casing 20 small to improve space efficiency.

Further, the support structure 40 is supported by the lower half of the inner casing 20, and between the outer circumference side constituent parts 52 of the stationary blade structures 50 except those on the horizontal end portion sides and the inner casing 20, the predetermined gap δa is provided. This makes it possible to maintain the structure without being restricted by deformation of the casing under thermal expansion conditions.

Here, the structure of the stationary blade cascade 29 of the first embodiment is not limited to the above-described structure, and the stationary blade cascade 29 may have any of other structures of the first embodiment described below. Note that the same operation and effect as those described previously can be obtained also when the stationary blade cascade 29 has any of the structures described below.

In the above-described first embodiment, the steam sealing structure between the stationary blade structure 50 and the turbine rotor 22 and the steam sealing structure between the inner circumference side, of the ring-shaped support part 42, facing the rotor blade cascade 25 and the outer circumferential surface of the rotor blade cascade 25, are not limited to the structures shown in FIG. 1 and FIG. 5. The steam sealing structures are not particularly limited, and may be any structure capable of preventing the leakage of the steam from gaps between these parts.

An example of another possible structure is that a seal fin is provided on one of the surfaces and the other surface facing this surface has an unlevelled structure. In this case, a soft layer such as an abradable layer which is cut even when the seal fin comes into contact with it, may be formed on a surface of the unlevelled structure of the other surface. The soft layer is formed by thermal spraying a soft material to the surface of the unlevelled structure. Further, the steam sealing structure may further include, for example, a brush seal to reduce the leakage of the steam.

Figure 13:
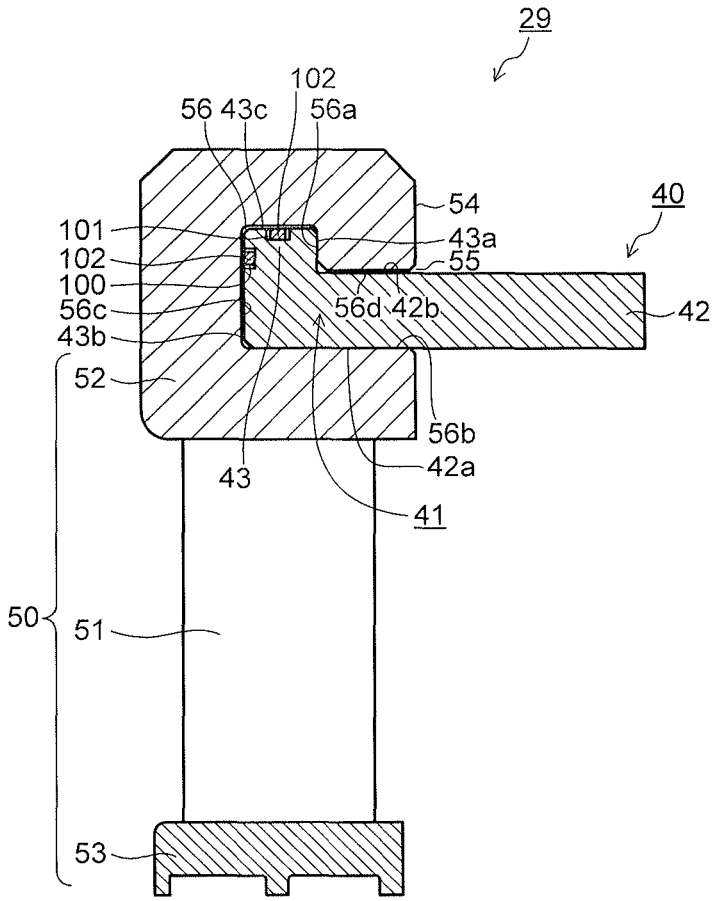
FIG. 13 is a view showing a meridian cross section of the stationary blade cascade of the first embodiment, and showing another structure of a fitting structure between a fitting portion of the support structure and a fitting groove of an outer circumference side constituent part.
Figure 14:
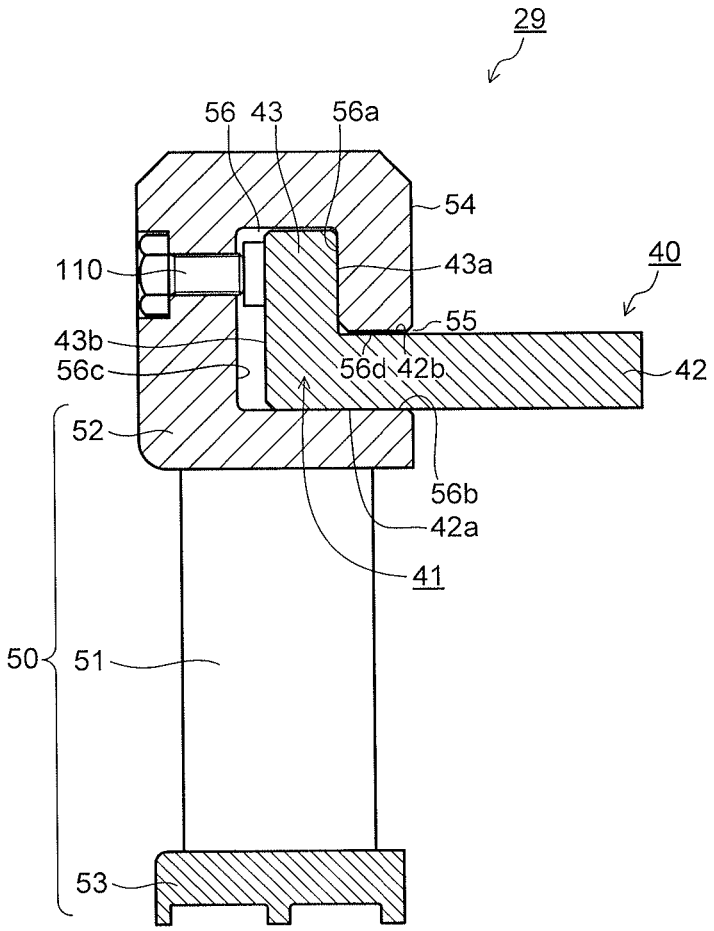
FIG. 14 is a view showing a meridian cross section of the stationary blade cascade of the first embodiment, and showing another structure of the fitting structure between the fitting portion of the support structure and the fitting groove of the outer circumference side constituent part.

FIG. 13 and FIG. 14 are views each showing a meridian cross section of the stationary blade cascade 29 of the first embodiment and shows other structures of the fitting structure between the fitting portion 41 of the support structure 40 and the fitting groove 56 of the outer circumference side constituent part 52.

As shown in FIG. 13, groove portions 100, 101 may be formed all along the circumferential direction in an upstream end surface 43*b* and a radially outward end surface 43*c* of the ridge portion 43 (fitting portion 41). Then, fastening members 102 in a plate shape may be inserted in these groove portions 100, 101 all along the circumferential direction. Consequently, the ridge portion 43 is pressed to the downstream side and radially inward, so that the downstream end surface 43*a* of the ridge portion 43 contacts on an inner wall surface 56*a* of the fitting groove 56, and an inner circumference-side end surface 42*a* of the ring-shaped support part 42 contacts on an inner wall surface 56*b* of the fitting groove 56.

Also, the structures composed of the groove portions 100, 101 and the fastening members 102 are preferably both formed as described above but one of them may be formed.

Another possible structure is that, as shown in FIG. 14*a*, a pressing member 110 such as a screw presses the ridge portion 43 toward the downstream side so that the downstream end surface 43*a* of the ridge portion 43 contacts on the inner wall surface 56*a* of the fitting groove 56.

In these cases, even if the gap between the upstream end surface 43*b* of the ridge portion 43 and the inner wall surface 56*c* of the fitting groove 56 and the gap between the radially outward end surface 42*b* of the ring-shaped support part 42 and the inner wall surface 56*d* of the fitting groove 56 are not set within the range of 0.03 mm to 0.12 mm, it is possible to prevent the rattling and the like during the operation. Further, since these gaps need not be set strictly within the range of 0.03 mm to 0.12 mm, it is possible to reduce manufacturing cost.

Figure 15:
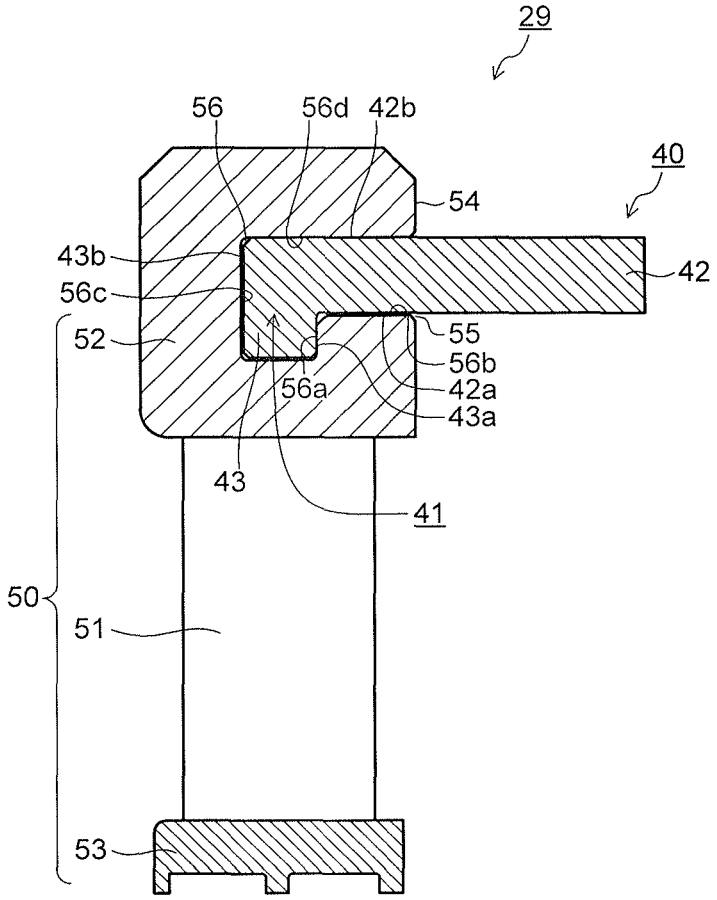
FIG. 15 is a view showing a meridian cross section of the stationary blade cascade of the first embodiment, and showing other shapes of the fitting groove of the outer circumference side constituent part and the support structure.
Figure 16:
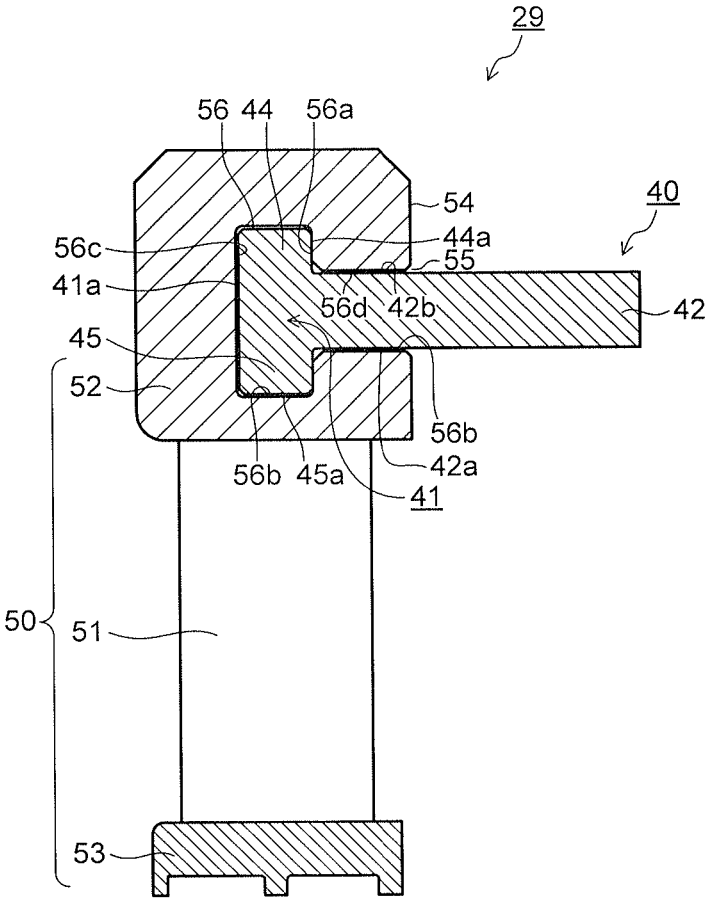
FIG. 16 is a view showing a meridian cross section of the stationary blade cascade of the first embodiment, and showing other shapes of the fitting groove of the outer circumference side constituent part and the support structure.
Figure 17:
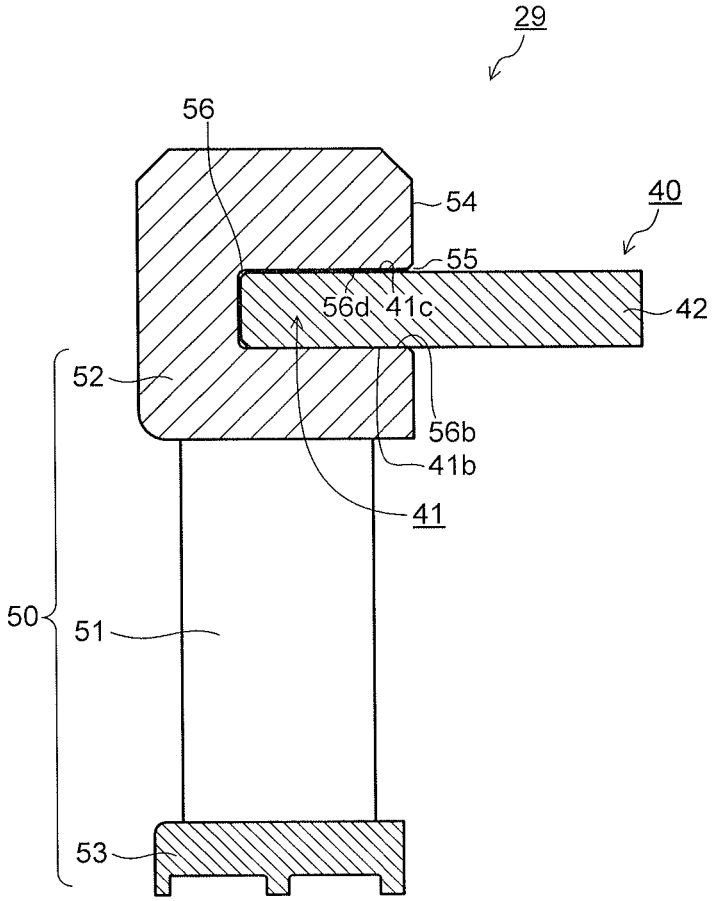
FIG. 17 is a view showing a meridian cross section of the stationary blade cascade of the first embodiment, and showing other shapes of the fitting groove of the outer circumference side constituent part and the support structure.

Further, the shape of the support structure 40 is not limited to the above-described L-shape. FIG. 15 to FIG. 17 are views each showing a meridian cross section of the stationary blade cascade 29 of the first embodiment and show other shapes of the fitting groove 56 of the outer circumference side constituent part 52 and the support structure 40.

As shown in FIG. 15, a fitting portion 41 of the support structure 40 includes a ridge portion 43 which is its one edge (upstream edge) projecting radially inward. That is, in the cross section shown in FIG. 15, the fitting portion 41 is formed in an L-shape. Further, a fitting groove 56 of the outer circumference side constituent part 52 is formed so as to match the shape of the fitting portion 41.

Here, as shown in FIG. 15, during the operation, a downstream end surface 43*a* of the ridge portion 43 of the support structure 40 contacts on an inner wall surface 56*a* of the fitting groove 56, and an inner circumference-side end surface 42*a* of the ring-shaped support part 42 contacts on an inner wall surface 56*b* of the fitting groove 56, in order to prevent the leakage of the steam. In this case, a gap between an upstream end surface 43*b* of the ridge portion 43 (fitting portion 41) and an inner wall surface 56*c* of the fitting groove 56 and a gap between a radially outward end surface 42*b* of the ring-shaped support part 42 and an inner wall surface 56*d* of the fitting groove 56, are preferably set within the range of 0.03 mm to 0.12 mm. This has been also confirmed by a FEM (finite element method) analysis, a mockup test, or the like that this dimension of these gaps is the most proper value. When the gaps are narrower than 0.03 mm, easy assembly is not possible. On the other hand, when the gaps are wider than 0.12 mm, rattling occurs during the operation.

As shown in FIG. 16, a fitting portion 41 of the support structure 40 includes ridge portions 44, 45 which are its one edge (upstream edge) projecting radially outward and radially inward respectively. That is, in the cross section shown in FIG. 16, the fitting portion 41 is formed in a T-shape. Further, a fitting groove 56 of the outer circumference side constituent part 52 is formed so as to match the shape of the fitting portion 41.

Here, as shown in FIG. 16, during the operation, a downstream end surface 44*a* of the ridge portion 44 of the support structure 40 contacts on an inner wall surface 56*a* of the fitting groove 56, and an inner circumference-side end surface 45*a* of the ridge portion 45 of the support structure 40 contacts on an inner wall surface 56*b* of the fitting groove 56, in order to prevent the leakage of the steam. In this case, a gap between an upstream end surface 41*a* of the fitting portion 41 and an inner wall surface 56*c* of the fitting groove 56 and a gap between a radially outward end surface 42*b* of the ring-shaped support part 42 and an inner wall surface 56*d* of the fitting groove 56, are preferably set within the range of 0.03 mm to 0.12 mm. This has been also confirmed by the FEM (finite element method, a mockup test, or the like that this dimension of these gaps is the most proper value. When the gaps are narrower than 0.03 mm, easy assembly is not possible. On the other hand, when the gaps are wider than 0.12 mm, rattling occurs during the operation.

As shown in FIG. 17, a fitting portion 41 of the support structure 40 extends in the turbine rotor axial direction without its one edge (upstream edge) projecting radially outward or radially inward. That is, the support structure 40 is formed of a circular ring whose outside diameter and inside diameter are constant along the turbine rotor axial direction. Therefore, in the cross section shown in FIG. 17, the fitting portion 41 is formed in an I-shape. Further, a fitting groove 56 of the outer circumference side constituent part 52 is formed so as to match the shape of the fitting portion 41.

Here, as shown in FIG. 17, during the operation, an inner circumference side end surface 41*b* of the fitting portion 41 of the support structure 40 contacts on an inner wall surface 56*b* of the fitting groove 56 in order to prevent the leakage of the steam. In this case, a gap between an outer circumference side end surface 41*c* of the fitting portion 41 of the support structure 40 and an inner wall surface 56*d* of the fitting groove 56 is preferably set within the range of 0.03 mm to 0.12 mm. This has been also confirmed by the FEM (finite element method, a mockup test, or the like that this dimension of the gap is the most proper value. When the gap is narrower than 0.03 mm, easy assembly is not possible. On the other hand, when the gap is wider than 0.12 mm, rattling occurs during the operation.

Figure 18:
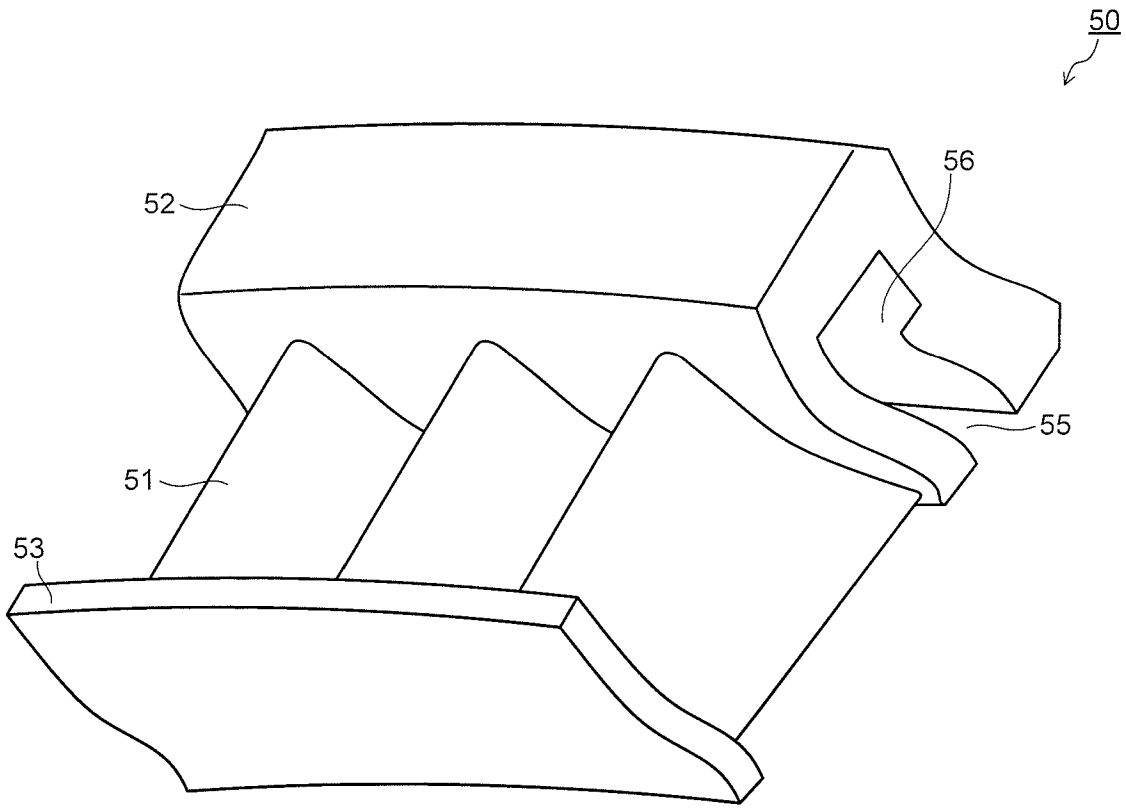
FIG. 18 is a perspective view showing a stationary blade structure with another structure included in the stationary blade cascade of the first embodiment.

Further, FIG. 18 is a perspective view showing a stationary blade structure 50 with another structure included in the stationary blade cascade 29 of the first embodiment. As the stationary blade structure 50, the example including one stationary blade part 51 between the outer circumference side constituent part 52 and the inner circumference side constituent part 53 is shown in the above, but the stationary blade structure is not limited to this. As shown in FIG. 18, a plurality of (three here) the stationary blade parts 51 may be provided in the circumferential direction between the outer circumference side constituent part 52 and the inner circumference side constituent part 53.

Second Embodiment

Figure 19:
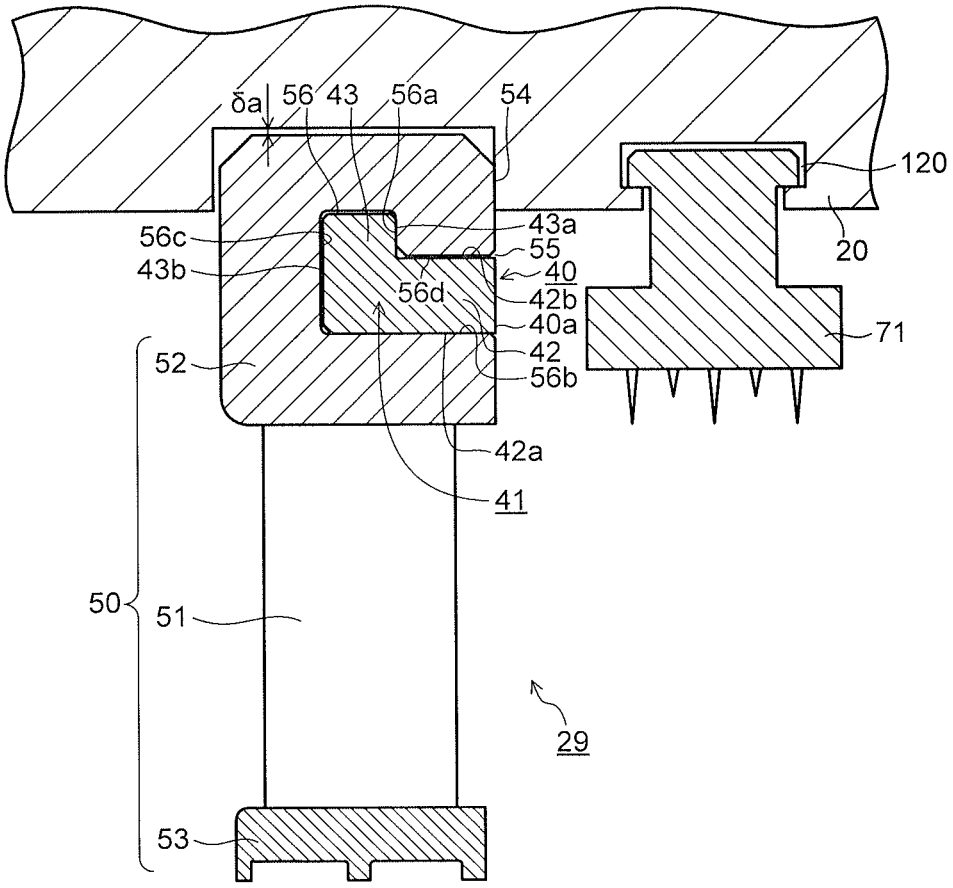
FIG. 19 is a view showing a meridian cross section of a stationary blade cascade of a second embodiment.

FIG. 19 is a view showing a meridian cross section of a stationary blade cascade 29 of a second embodiment. Note that part of an inner casing 20 is also shown in FIG. 19.

Here, a structure in which a ring-shaped support part 42 of a support structure 40 does not extend in a turbine rotor axial direction and functions mainly as a fitting portion 41 will be described. As shown in FIG. 19, a downstream end surface 40*a* of the support structure 40 is located substantially at the same turbine rotor axial direction position as that of an opening 55 formed in a downstream end surface 54 of an outer circumference side constituent part 52.

Therefore, here, a fitting groove 120 is formed all along a circumferential direction in an inner circumference side of the inner casing 20 immediately downstream of the stationary blade cascade 29, and a labyrinth packing 71 is fitted in the fitting groove 120. The labyrinth packing 71 is provided so as to cover, at a predetermined interval, an outer periphery of a rotor blade cascade 25 located downstream of the stationary blade cascade 29. Thus providing the labyrinth packing 71 makes it possible to reduce a flow amount of steam leaking from between the rotor blade cascade 25 and the inner casing 20.

According to the stationary blade cascade 29 of the second embodiment, it is possible to support stationary blade structures 50 by the support structure 40 provided on the inner side of the casing without providing a diaphragm outer ring. This makes it possible to decrease outside diameters of the stationary blade cascade 29 and the inner casing 20 to improve space efficiency.

Further, the support structure 40 is supported by a lower half of the inner casing 20, and there is a predetermined gap

8*a* between the outer circumference side constituent parts 52 of the stationary blade structures 50 except those on horizontal end portion sides and the inner casing 20. This can maintain the structure without being restricted by deformation of the casing under thermal expansion conditions.

Here, the example is shown where the downstream end surface 40*a* of the support structure 40 is located substantially at the same turbine rotor axial direction position as that of the opening 55 formed in the downstream end surface 54 of the outer circumference side constituent part 52. By adjusting the turbine rotor axial direction position of the downstream end surface 40*a* of the support structure 40, that is, a length of the support structure 40 toward the downstream side, it is possible to adjust a natural frequency of the support structure 40 (ring-shaped support part 42) to avoid resonance. Consequently, it is possible to provide a highly reliable turbine stage.

Here, in view of maintaining strength of the support structure 40, the turbine rotor axial direction position of the downstream end surface 40*a* of the support structure 40 is preferably the same as or more downstream than that of the opening 55 formed in the downstream end surface 54 of the outer circumference side constituent part 52.

The shapes of a fitting groove 56 of the outer circumference side constituent part 52 and the fitting portion 41 of the support structure 40 and so on are the same as those in the first embodiment. Further, a steam sealing structure between the rotor blade cascade 25 and the inner casing 20 is not limited to the structure formed of the labyrinth packing 71 but the steam sealing structure shown in the first embodiment is adoptable.

Third Embodiment

Figure 20:
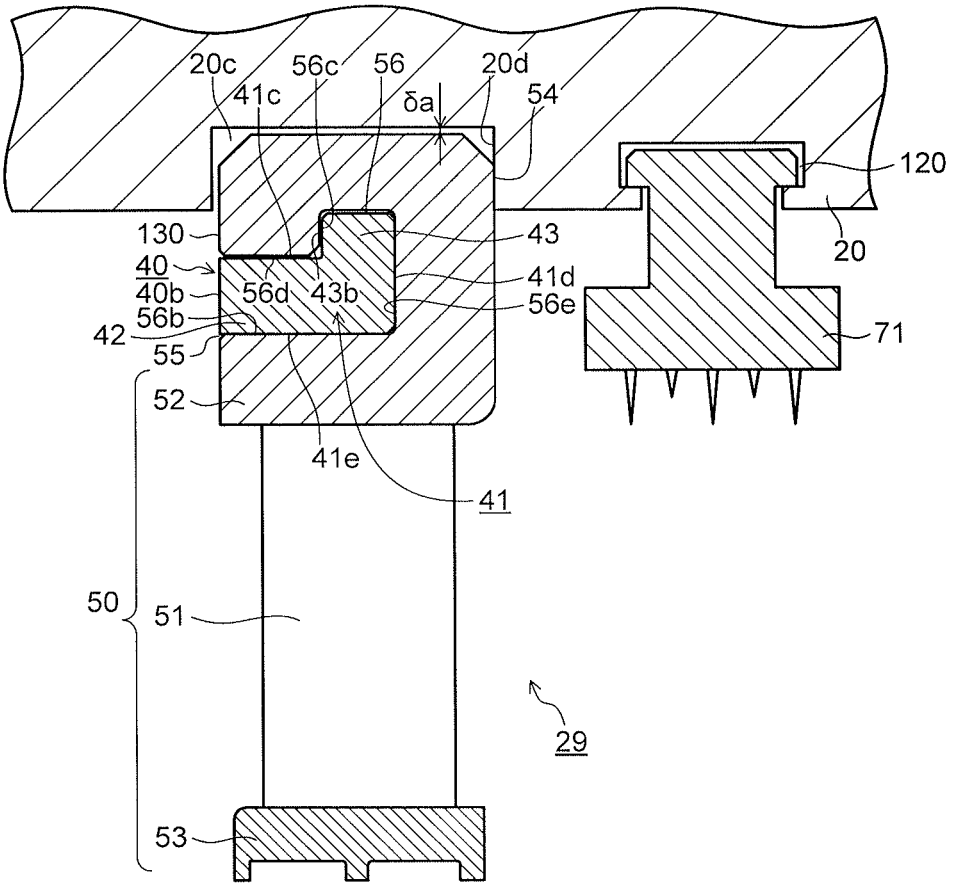
FIG. 20 is a view showing a meridian cross section of a stationary blade cascade of a third embodiment.

FIG. 20 is a view showing a meridian cross section of a stationary blade cascade 29 of a third embodiment. Note that part of an inner casing 20 is also shown in FIG. 20.

As shown in FIG. 20, an outer circumference side constituent part 52 is formed on an outer circumference side of a stationary blade part 51 and is formed of a ring-shaped block structure. In the outer circumference side constituent part 52, a fitting groove 56 is formed which penetrates all along a circumferential direction and has an opening 55 all along the circumferential direction in an upstream end surface 130. As shown in FIG. 20, the fitting groove 56 is formed so that it has a predetermined groove width in a radial direction, and on a downstream side (right side in FIG. 20), the groove widens radially outward to increase the groove width. That is, in the cross section shown in FIG. 20, the fitting groove 56 is formed in an L-shape.

As shown in FIG. 20, in the outer circumference side constituent part 52, part of an outer circumference of the outer circumference side constituent part 52 is fitted in a groove 20*c* formed all along the circumferential direction in an inner wall of the inner casing 20 so as to be movable in a turbine rotor axial direction and radially outward. During the operation of a steam turbine, a downstream end surface 54 of the outer circumference side constituent part 52 contacts on a downstream end surface 20*d* of the groove 20*c*, so that the movement of the stationary blade cascade 29 in the turbine rotor axial direction is prevented.

As shown in FIG. 20, a support structure 40 includes a ring-shaped support part 42 having a fitting portion 41 fitted in the fitting groove 56 of the outer circumference side constituent part 52. The fitting portion 41 has the same shape as the shape of the fitting groove 56 of the outer circumference side constituent part 52, and includes a ridge portion 43 which is its one edge (downstream-side edge) projecting radially outward. That is, in the cross section shown in FIG. 2, the support structure 40 is formed in an L-shape.

The ring-shaped support part 42 of the support structure 40 does not extend in the turbine rotor axial direction and functions mainly as the fitting portion 41. Here, as shown in FIG. 20, the example is shown where an upstream end surface 40*b* of the support structure 40 is located substantially at the same turbine rotor axial direction position as that of the opening 55 formed in the upstream end surface 130 of the outer circumference side constituent part 52.

By adjusting the turbine rotor axial direction position of the upstream end surface 40*b* of the support structure 40, that is, a length of the support structure 40 toward the upstream side, it is possible to adjust a natural frequency of the support structure 40 (ring-shaped support part 42) to avoid resonance. This makes it possible to provide a highly reliable turbine stage.

Here, in view of maintaining strength of the support structure 40, the turbine rotor axial direction position of the upstream end surface 40*b* of the support structure 40 is preferably the same as or more upstream than that of the opening 55 formed in the upstream end surface 130 of the outer circumference side constituent part 52.

Further, a fitting groove 120 is formed all along a circumferential direction in an inner circumference of the inner casing 20 immediately downstream of the stationary blade cascade 29, and a labyrinth packing 71 is fitted in the fitting groove 120. The labyrinth packing 71 is provided so as to cover, at a predetermined interval, an outer periphery of a rotor blade cascade 25 located downstream of the stationary blade cascade 29. Thus providing the labyrinth packing 71 makes it possible to reduce a flow amount of steam leaking from between the rotor blade cascade 25 and the inner casing 20.

Here, as shown in FIG. 20, during the operation, a downstream end surface 41*d* of the fitting portion 41 of the support structure 40 contacts on an inner wall surface 56*e* of the fitting groove 56, and an inner circumference-side end surface 41*e* of the fitting portion 41 contacts on an inner wall surface 56*b* of the fitting groove 56, in order to prevent the leakage of the steam. In this case, a gap between an upstream end surface 43*b* of the ridge portion 43 and an inner wall surface 56*c* of the fitting groove 56 and a gap between a radially outward end surface 41*c* of the fitting portion 41 and an inner wall surface 56*d* of the fitting groove 56, are preferably set within a range of 0.03 mm to 0.12 mm. This has been also confirmed by a FEM (finite element method) analysis, a mockup test, or the like that this dimension of these gaps is the most proper value. When the gaps are narrower than 0.03 mm, easy assembly is not possible. On the other hand, when the gaps are wider than 0.12 mm, rattling occurs during the operation.

In the stationary blade cascade 29 of the third embodiment, since the opening 55 is formed in the upstream end surface 130 of the outer circumference side constituent part 52, the structure of the outer circumference side constituent part 52 of the stationary blade structure 50 located lowest is preferably the structure shown in FIG. 11. That is, it is preferably a structure in which a block member 95 is provided on an outer circumferential end surface of the outer circumference side constituent part 52 of the stationary blade structure 50 located lowest and a concave portion 59 is formed in the block member 95.

Such a structure can prevent the interference between the block member 95 and the ring-shaped support part 42. Note that, in order to prevent an increase in an outside diameter of the stationary blade structure 50 as much as possible, a thickness of the block member 95 is preferably as small as possible within a range capable of maintaining strength.

According to the stationary blade cascade 29 of the third embodiment, it is possible to support stationary blade structures 50 by the support structure 40 provided on the inner side of the casing without providing a diaphragm outer ring. This makes it possible to decrease outside diameters of the stationary blade cascade 29 and the inner casing 20 to improve space efficiency.

Further, the support structure 40 is supported by a lower half of the inner casing 20, and there is a predetermined gap δa between the outer circumference side constituent parts 52 of the stationary blade structures 50 except those on horizontal end portion sides and the inner casing 20. This can maintain the structure without being restricted by deformation of the casing under thermal expansion conditions.

The shapes of the fitting groove 56 of the outer circumference side constituent part 52 and the fitting portion 41 of the support structure 40 and so on are the same as those in the first embodiment. Further, a steam sealing structure between the rotor blade cascade 25 and the inner casing 20 is not limited to the structure formed of the labyrinth packing 71 but the steam sealing structure shown in the first embodiment is adoptable.

Fourth Embodiment

Figure 21:
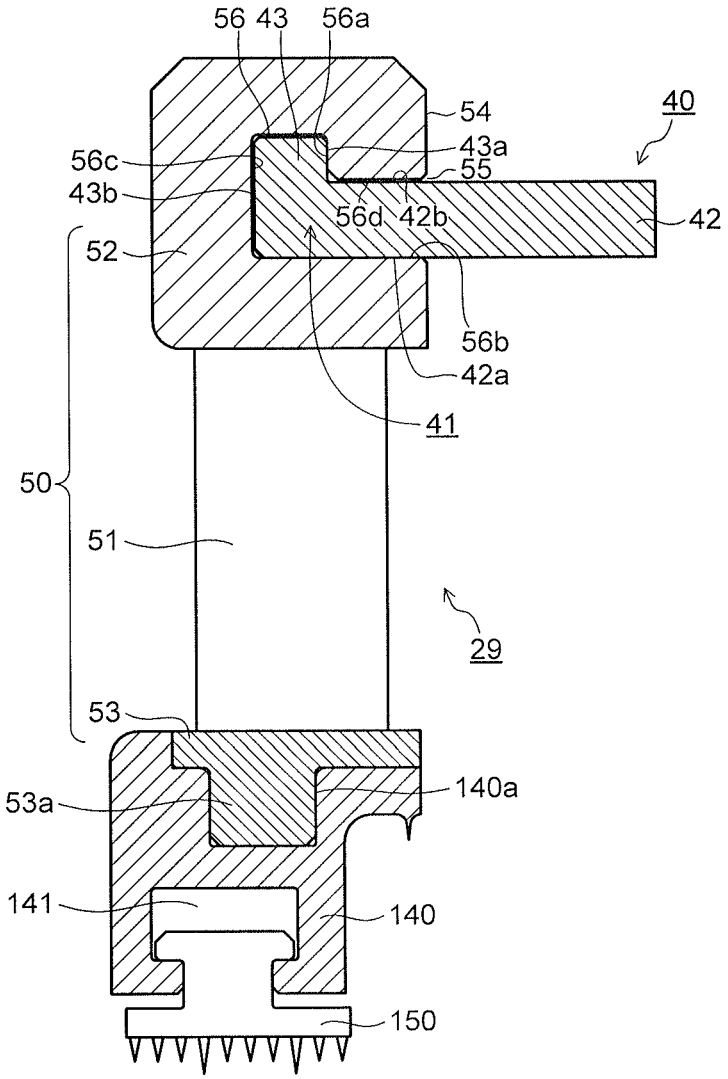
FIG. 21 is a view showing a meridian cross section of a stationary blade cascade of a fourth embodiment.
Figure 22:
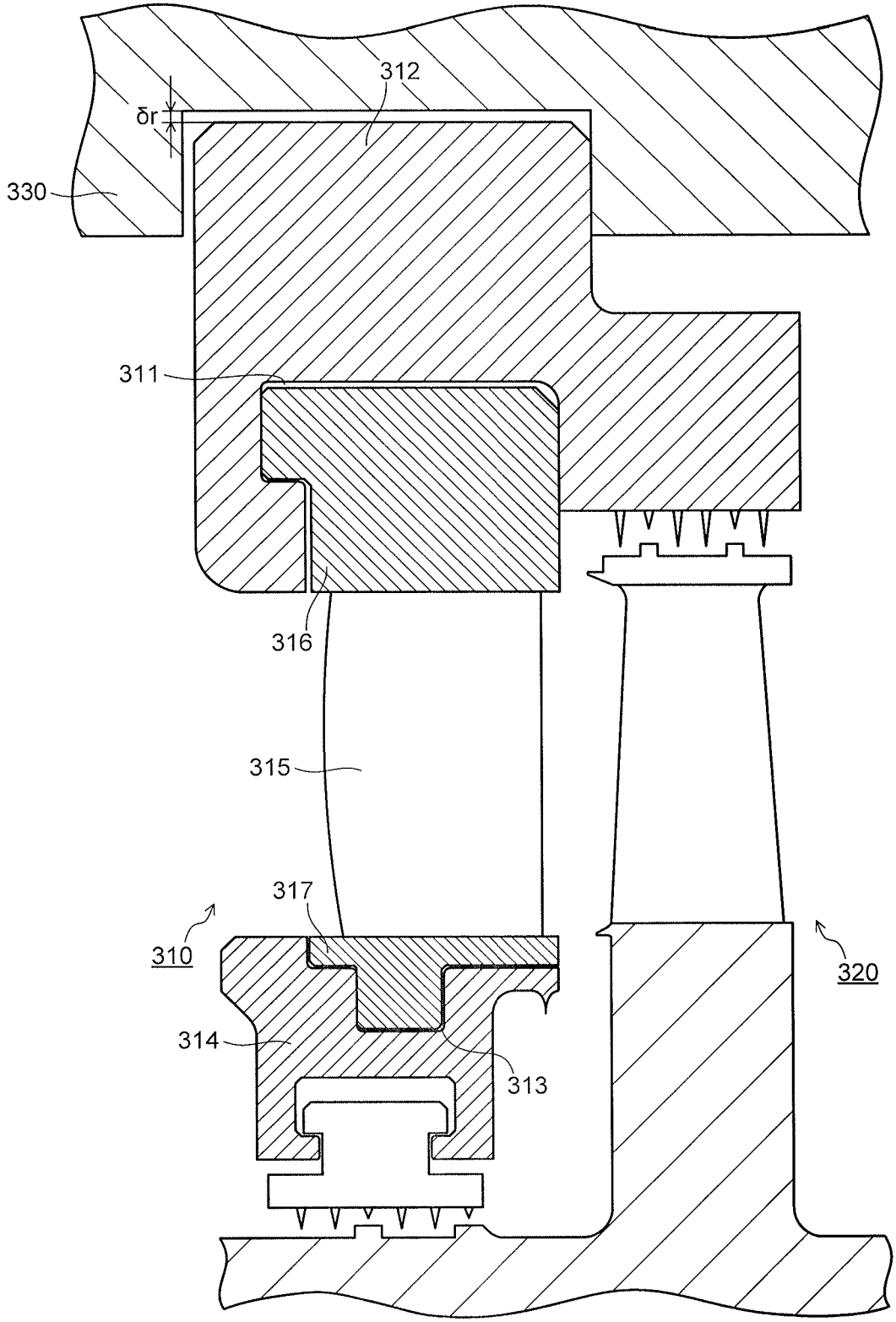
FIG. 22 is a view showing a meridian cross section of a conventional steam turbine including stationary blade cascades between a diaphragm outer ring and a diaphragm inner ring.
Figure 23:
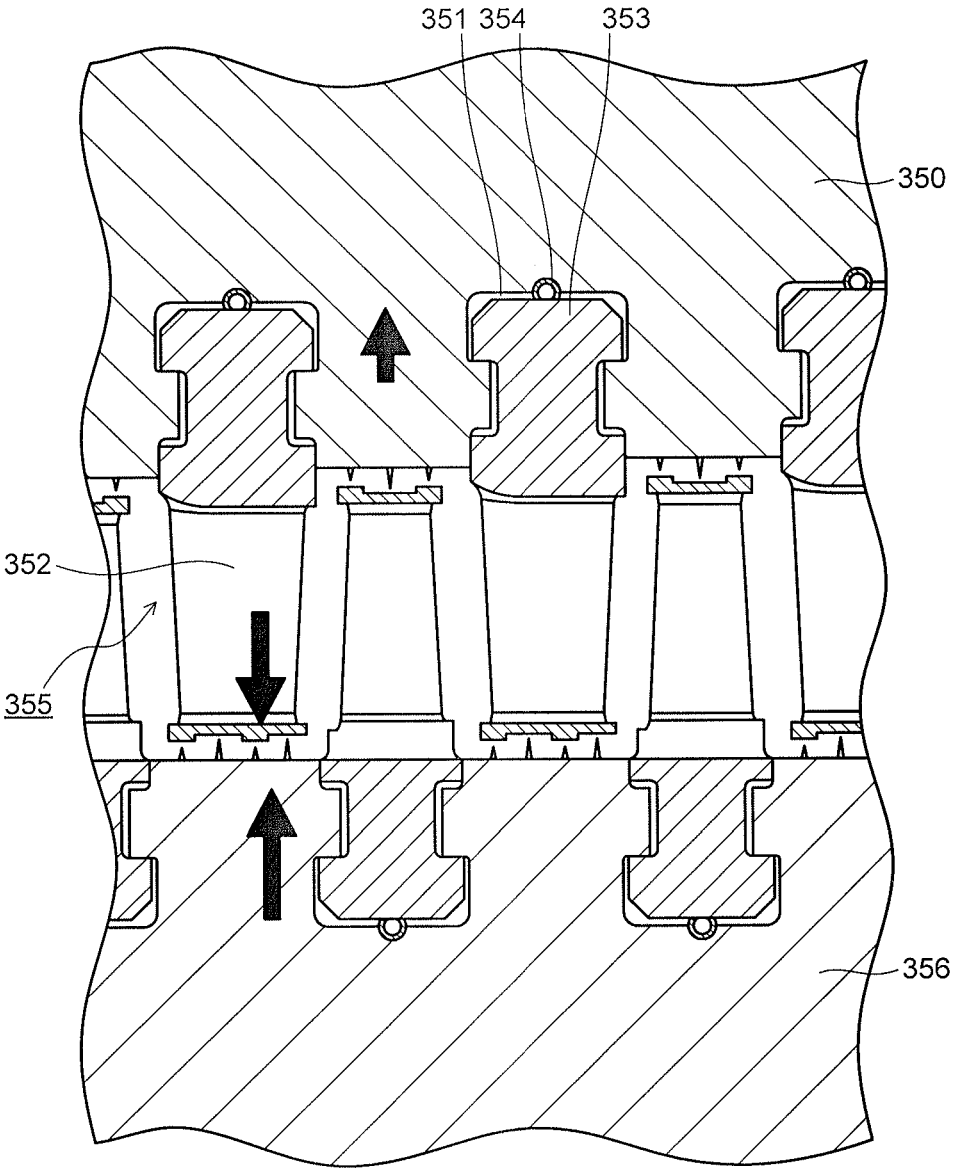
FIG. 23 is a view showing a meridian cross section of a conventional steam turbine including stationary blade cascades having stationary blades arranged in a circumferential direction on an inner circumference of a casing.

FIG. 21 is a view showing a meridian cross section of a stationary blade cascade 29 of a fourth embodiment.

The structure shown in FIG. 21 is a structure including a diaphragm inner ring 140 on an inner circumference side of the stationary blade cascade 29 of the first embodiment. That is, FIG. 21 shows a structure including: a stationary blade cascade 29 of the fourth embodiment including stationary blade structures 50 and a support structure 40 supporting the stationary blade structures 50; and the diaphragm inner ring 140 on the inner circumference side of the stationary blade cascade 29. The diaphragm inner ring 140 is formed of a ring-shaped member having a two-divided structure of an upper half and a lower half, similarly to a ring-shaped support part 42.

On an inner side of the inner circumference side constituent part 53 of the stationary blade cascade 29, a projecting portion 53*a* projecting radially inward is formed in a circumferential direction. On the other hand, in an outer circumference side of the diaphragm inner ring 140, a concave portion 140*a* fitted to the projecting portion 53*a* of the inner circumference side constituent part 53 is formed in the circumferential direction. For example, the diaphragm inner ring 140 is fixed to the inner circumference side constituent parts 53, at horizontal end portions by bolt fastening or the like.

In an inner circumference side of the diaphragm inner ring 140, a fitting groove 141 is formed all along the circumferential direction. A labyrinth packing 150 is fitted in the fitting groove 141. The labyrinth packing 150 is provided so as to cover, at a predetermined interval, an outer periphery of a turbine rotor 22 facing the labyrinth packing 150.

Here, the ring-shaped support part 42 extends in a turbine rotor axial direction so as to cover a periphery of a rotor blade cascade 25, not shown in FIG. 21, located downstream of the stationary blade cascade 29 as shown in the first embodiment. Therefore, it is possible to provide a steam sealing structure on an inner circumference side, of the ring-shaped support part 42, facing the rotor blade cascade 25. Note that the steam sealing structure is as shown in the first embodiment.

An assembling method of the stationary blade cascade 29 of the fourth embodiment will be described.

In addition to the process for completing the lower half of the stationary blade cascade 29 attachable to the lower half of the inner casing 20 in the above-described assembling method of the stationary blade cascade 29 of the first embodiment, this assembling method includes a process for fitting and fixing the lower half of the diaphragm inner ring 140 to the inner circumference side constituent parts 53.

Specifically, fitting grooves 56 of the stationary blade structures 50 are fit to a fitting portion 41 of the lower half of the ring-shaped support part 42, whereby the plural stationary blade structures 50 are installed in the circumferential direction. Subsequently, the projecting portions 53*a* of the inner circumference side constituent parts 53 and the concave portion 140*a* in the inner circumference side of the lower half of the diaphragm inner ring 140 are fit to each other. Subsequently, detachment preventing members 90 preventing the stationary blade structures 50 from detaching from horizontal end portions of the lower half of the ring-shaped support part 42 are attached, and the lower half of the diaphragm inner ring 140 is fixed to the inner circumference side constituent parts 53, for example, at the horizontal end portions by bolt fastening or the like.

Here, the process for installing the stationary blade structures 50 onto the lower half of the ring-shaped support part 42 and the process for fitting the projecting portions 53*a* of the inner circumference side constituent parts 53 into the concave portion 140*a* of the lower half of the diaphragm inner ring 140 may be performed at the same time.

Further, this assembling method further includes a process for fitting and fixing the upper half of the diaphragm inner ring 140 to the inner circumference side constituent parts 53, in addition to the process for completing the upper half of the stationary blade cascade 29 attachable to the lower half of the inner casing 20 in the above-described assembling method of the stationary blade cascade 29 of the first embodiment.

Specifically, the fitting grooves 56 of the stationary blade structures 50 are fitted to the fitting portion 41 of the upper half of the ring-shaped support part 42, whereby the plural stationary blade structures 50 are installed in the circumferential direction. Subsequently, the projecting portions 53*a* of the inner circumference side constituent parts 53 and the concave portion 140*a* in the inner circumference side of the upper half of the diaphragm inner ring 140 are fit to each other. Subsequently, detachment preventing members 90 preventing the stationary blade structures 50 from detaching from the horizontal end portions of the upper half of the ring-shaped support part 42 are attached, and the upper half of the diaphragm inner ring 140 is fixed to the inner circumference side constituent parts 53, for example, at the horizontal end portions by bolt fastening or the like.

Here, the process for installing the stationary blade structures 50 on the upper half of the ring-shaped support part 42 and the process for fitting the projecting portions 53*a* of the inner circumference side constituent parts 53 into the concave portion 140*a* of the upper half of the diaphragm inner ring 140 may be performed at the same time.

This assembling method has the same processes as those of the assembling method of the stationary blade cascade 29 of the first embodiment described previously except the above-described processes.

According to the stationary blade cascade 29 of the fourth embodiment, it is possible to support the stationary blade structures 50 by the support structure 40 provided on the inner side of the casing without providing a diaphragm outer ring. This makes it possible to reduce outside diameters of the stationary blade cascade 29 and the inner casing 20 to improve space efficiency.

Further, the support structure 40 is supported by the lower half of the inner casing 20, and there is a predetermined gap δa between the outer circumference side constituent parts 52 of the stationary blade structures 50 except those on the horizontal end portion sides and the inner casing 20. This makes it possible to maintain the structure without being restricted by deformation of the casing under thermal expansion conditions.

Providing the diaphragm inner ring 140 makes it possible to maintain rigidity even in a turbine stage where a pressure difference between an inlet and an outlet of the stationary blade cascade 29 is large, which enables the operation under a wide steam condition range.

Here, the shapes of the fitting groove 56 of the outer circumference side constituent part 52 and the fitting portion 41 of the support structure 40 and so on are the same as those in the first embodiment. Further, the structure of the second or third embodiment is also adoptable.

According to the above-described embodiments, by realizing the downsizing, it is possible to improve space efficiency and to maintain the structure without being restricted by the deformation of the casing under thermal expansion conditions.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A stationary blade cascade for steam turbine which includes a plurality of stationary blades arranged in a circumferential direction and which is formed in a ring shape, the stationary blade cascade comprising:

a plurality of stationary blade structures each having:

a stationary blade part through which steam passes; and an outer circumference side constituent part formed on an outer circumference side of the stationary blade part, the outer circumference side constituent part having a fitting groove formed all along the circumferential direction in an upstream end surface or a downstream end surface of the outer circumferential side constituent part, the fitting groove having:

an opening at the upstream end surface or the downstream end surface; and a groove bottom space at an end of the fitting groove penetrated all along the circumferential direction, the groove bottom space having wider width than the opening in a radial direction of the ring shape; and a support structure in a ring shape, the support structure having a ring-shaped support part which has a fitting portion fitted in the fitting grooves of the outer circumference side constituent parts, the ring-shaped support part supporting the plurality of stationary blade structures along the circumferential direction.

2. The stationary blade cascade according to claim 1, wherein the stationary blade structure includes at least one stationary blade part in the circumferential direction.

3. The stationary blade cascade according to claim 1, wherein the ring-shaped support part has a steam sealing structure on an inner circumference side thereof facing the rotor blade cascade where the opening is formed in the downstream end surface of the outer circumference side constituent part and the ring-shaped support part extends to an outer periphery of a rotor blade cascade.

4. The stationary blade cascade according to claim 1, further comprising an inner circumference side constituent part formed of a block structure and provided on an inner circumference side, of the stationary blade part, facing a turbine rotor.

5. The stationary blade cascade according to claim 4, wherein the inner circumference side constituent part has a steam sealing structure on an inner side thereof, facing the turbine rotor.

6. The stationary blade cascade according to claim 1, wherein the ring-shaped support part has a divided structure including an upper half and a lower half.

7. The stationary blade cascade according to claim 6, wherein the stationary blade structures located on horizontal end portion sides have engagement portions projecting radially outward on the outer circumference side constituent parts thereof among the stationary blade structures fitted to the lower half of the ring-shaped support part, to engage with stepped portions formed on horizontal end portion sides of a lower half of a casing.

8. The stationary blade cascade according to claim 7, wherein the engagement portions are each formed by radially outward extension of the outer circumference side constituent part of the stationary blade structure located on the horizontal end portion side.

9. The stationary blade cascade according to claim 7, wherein the engagement portions are each formed by joining an engagement part to an outer periphery of the outer circumference side constituent part of the stationary blade structure located on the horizontal end portion side.

10. The stationary blade cascade according to claim 6, wherein the stationary blade structure located lowest among the stationary blade structures fitted to the lower half of the ring-shaped support part has a concave in an outer circumferential end surface of the outer circumference side constituent part thereof for installing a fitting between the outer circumferential end surface and a concave formed in an inner circumference of a lower half of a casing facing the outer circumferential end surface.

11. A steam turbine, comprising:

a casing;

a turbine rotor penetratingly provided in the casing;

a plurality of stages of rotor blade cascades provided in a turbine rotor axial direction and each including a plurality of rotor blades implanted in a circumferential direction of the turbine rotor; and a plurality of stages of stationary blade cascades provided alternately with the rotor blade cascades in the turbine rotor axial direction and each including a plurality of stationary blades provided in the circumferential direction, wherein at least one stage of the stationary blade cascade is formed of the stationary blade cascade according to claim 1.

12. The steam turbine according to claim 11, wherein at least part of each of the outer circumference side constituent parts is fitted in a groove formed all along the circumferential direction in an inner wall of the casing so as to be movable at least in the turbine rotor axial direction.

13. An assembling method of a stationary blade cascade for steam turbine configured to include a plurality of stationary blades in a circumferential direction and formed in a ring shape, the stationary blade cascade comprising:

a plurality of stationary blade structures each having: a stationary blade part through which steam passes;

an outer circumference side constituent part formed on an outer circumference side of the stationary blade part, the outer circumference side constituent part having a fitting groove formed all along the circumferential direction in an upstream end surface or a downstream end surface of the outer circumferential side constituent part the fitting grove having:

an opening at the upstream end surface or the downstream end surface; and a groove bottom space at an end of the fitting groove penetrated all along the circumferential direction, the groove bottom space having wider width than the opening in a radial direction of the ring shape; and an inner circumference side constituent part provided on an inner circumference side, of the stationary blade part, facing the turbine rotor and which is formed of a block structure; and a support structure in a ring shape, the support structure having a ring-shaped support part which has a fitting portion fitted in the fitting grooves of the outer circumference side constituent parts and which has a divided structure including an upper half and a lower half, the assembling method, comprising:

fitting the fitting grooves of the stationary blade structures to the fitting portion of the lower half of the ring-shaped support part to install the plural stationary blade structures in the circumferential direction;

attaching detachment preventing parts for the lower half to prevent the stationary blade structures from detaching from horizontal end portions of the lower half of the ring-shaped support part;

engaging engagement portions which are formed on the outer circumference side constituent parts of the stationary blade structures located on the horizontal end portion sides among the stationary blade structures fitted to the lower half of the ring-shaped support part and which project radially outward, with stepped portions formed on horizontal end portion sides of a lower half of a casing, and fitting a fitting member between a concave portion which is formed in an outer circumferential end surface of the outer circumference side constituent part of the stationary blade structure located lowest among the stationary blade structures fitted to the lower half of the ring-shaped support part and a concave portion which is formed in an inner circumference of the lower half of the casing;

installing the turbine rotor in which rotor blade cascades are formed, with the rotor blade cascades being alternately arranged with the lower halves of the ring-shaped support parts in the turbine rotor axial direction;

fitting the fitting grooves of the stationary blade structures to the fitting portion of the upper half of the ring-shaped support part to install the plural stationary blade structures in the circumferential direction;

attaching detachment preventing parts for upper half which prevent the stationary blade structures from detaching from horizontal end portions of the upper half of the ring-shaped support part; and installing the upper half of the ring-shaped support part in which the detachment preventing parts for upper half are attached, on the lower half of the ring-shaped support part to form the ring-shaped stationary blade cascade.

14. The assembling method of the stationary blade cascade according to claim 13, wherein the stationary blade structures each include at least one stationary blade part in the circumferential direction.

* * * * *